US007441371B2

(12) United States Patent
Kinsey

(10) Patent No.: US 7,441,371 B2
(45) **Date of Patent: *Oct. 28, 2008**

(54) WINDOW SASH TILT CONTROL

(76) Inventor: Bruce F. Kinsey, P.O. Box 1936, Beaufort, SC (US) 29901-1936

( * ) Notice: Subject to any disclaimer, the term of this patent is extended or adjusted under 35 U.S.C. 154(b) by 0 days.

This patent is subject to a terminal disclaimer.

(21) Appl. No.: 11/488,415

(22) Filed: Jul. 18, 2006

(65) Prior Publication Data

US 2006/0260198 A1 Nov. 23, 2006

Related U.S. Application Data

(63) Continuation-in-part of application No. 10/978,943, filed on Nov. 1, 2004, now Pat. No. 7,111,430, which is a continuation-in-part of application No. 10/116,915, filed on Apr. 8, 2002, now Pat. No. 6,823,626, which is a continuation-in-part of application No. 09/657,243, filed on Sep. 7, 2000, now abandoned.

(51) Int. Cl.
*E05D 15/22* (2006.01)

(52) U.S. Cl. ..... 49/187

(58) Field of Classification Search ..... 49/161, 49/163, 176, 187, 445
See application file for complete search history.

(56) References Cited

U.S. PATENT DOCUMENTS

| | | | | |
|---|---|---|---|---|
| 1,117,954 | A * | 11/1914 | Davison | 49/150 |
| 1,297,892 | A * | 3/1919 | Mutchnik et al. | 49/186 |
| 6,823,626 | B2 * | 11/2004 | Kinsey | 49/187 |
| 7,111,430 | B2 * | 9/2006 | Kinsey | 49/187 |

* cited by examiner

*Primary Examiner*—Jerry Redman

(57) ABSTRACT

The window assembly structure includes a control bar for limiting the extent of inward tilting of the sash commonly used for safe window cleaning. The control bar is forced to bend or distort during tilting of the sash producing a bias force that limits the amount of tilting. In a preferred structure the control bar is of a spring steel wire structure with various bent segments for effective and cost efficient securement of the control bar to the sash and frame.

11 Claims, 41 Drawing Sheets

Fig # 1
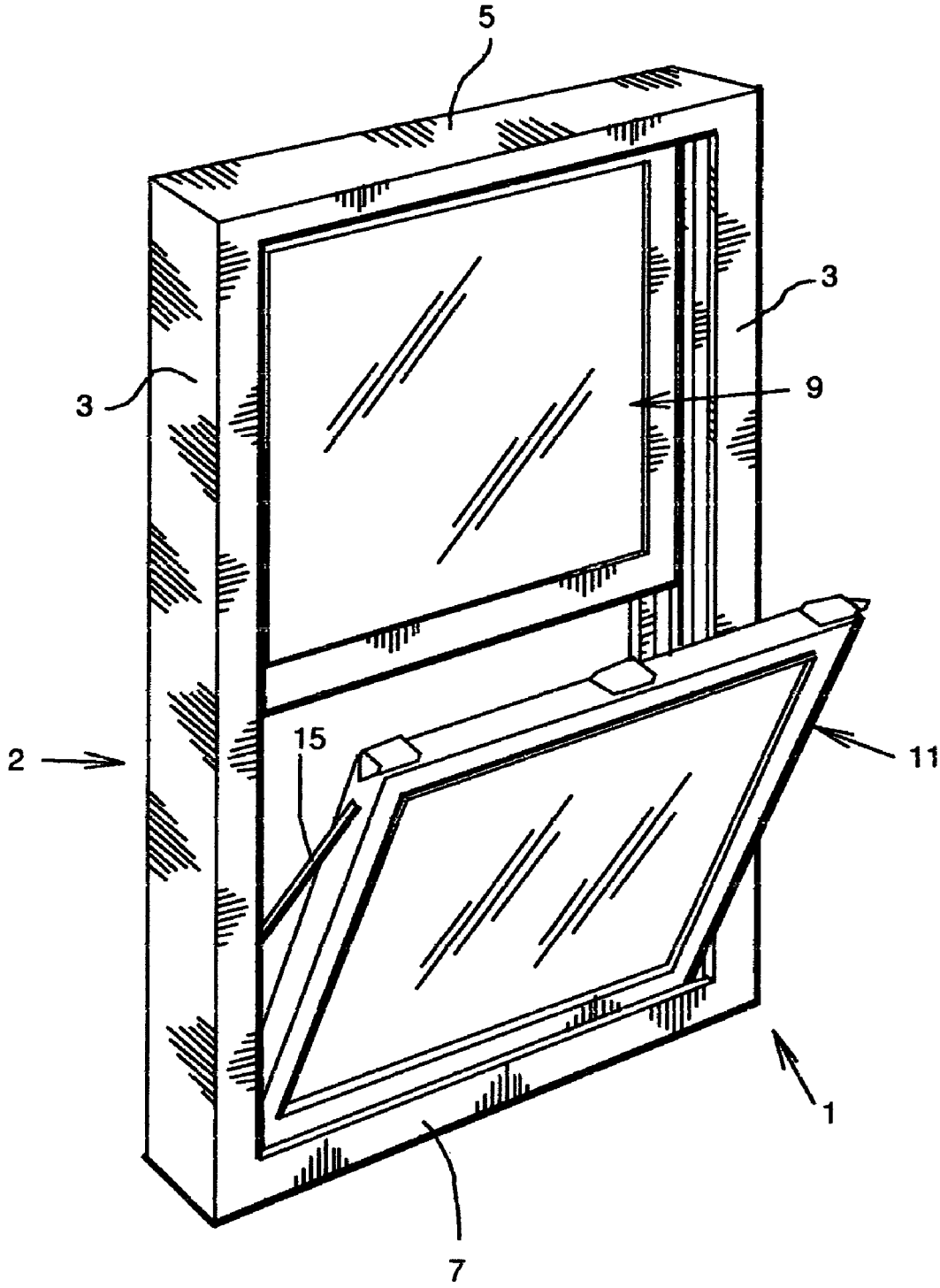

Fig # 2
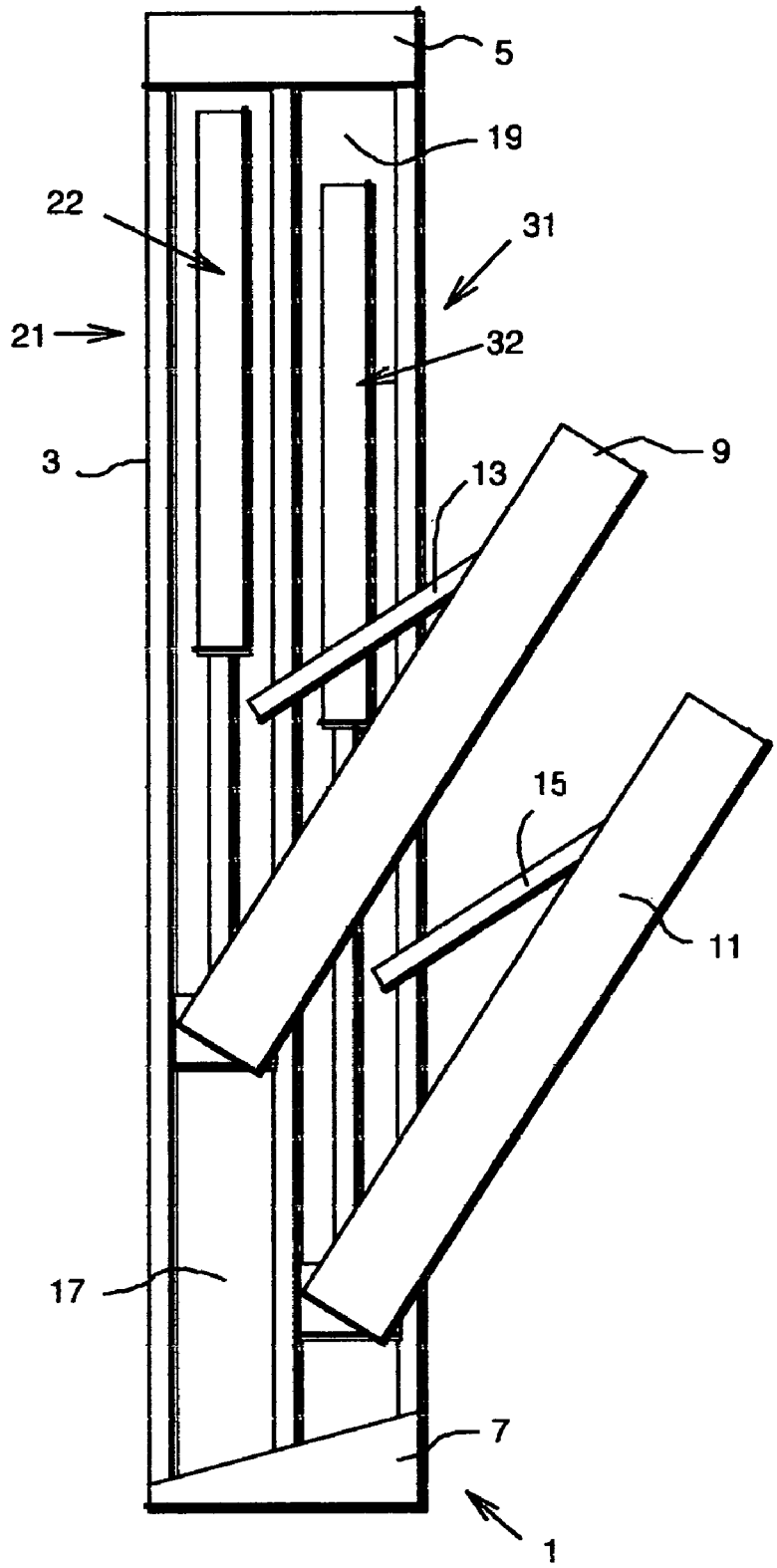

Fig # 3
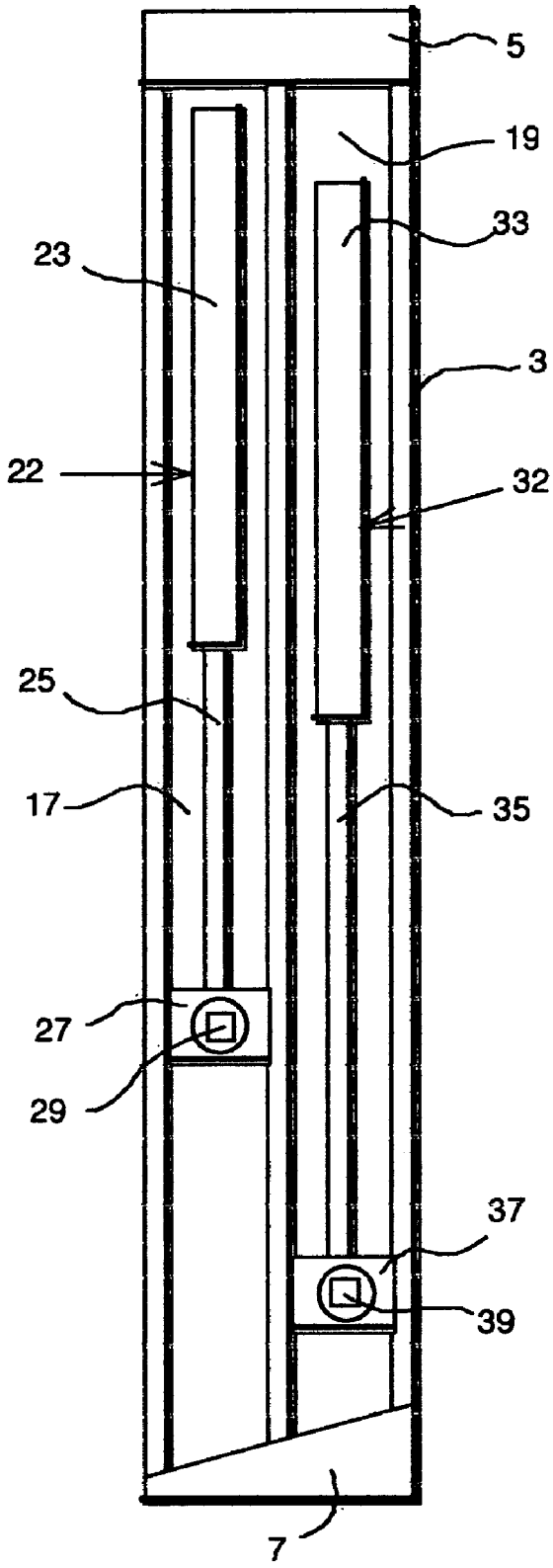

Fig # 4
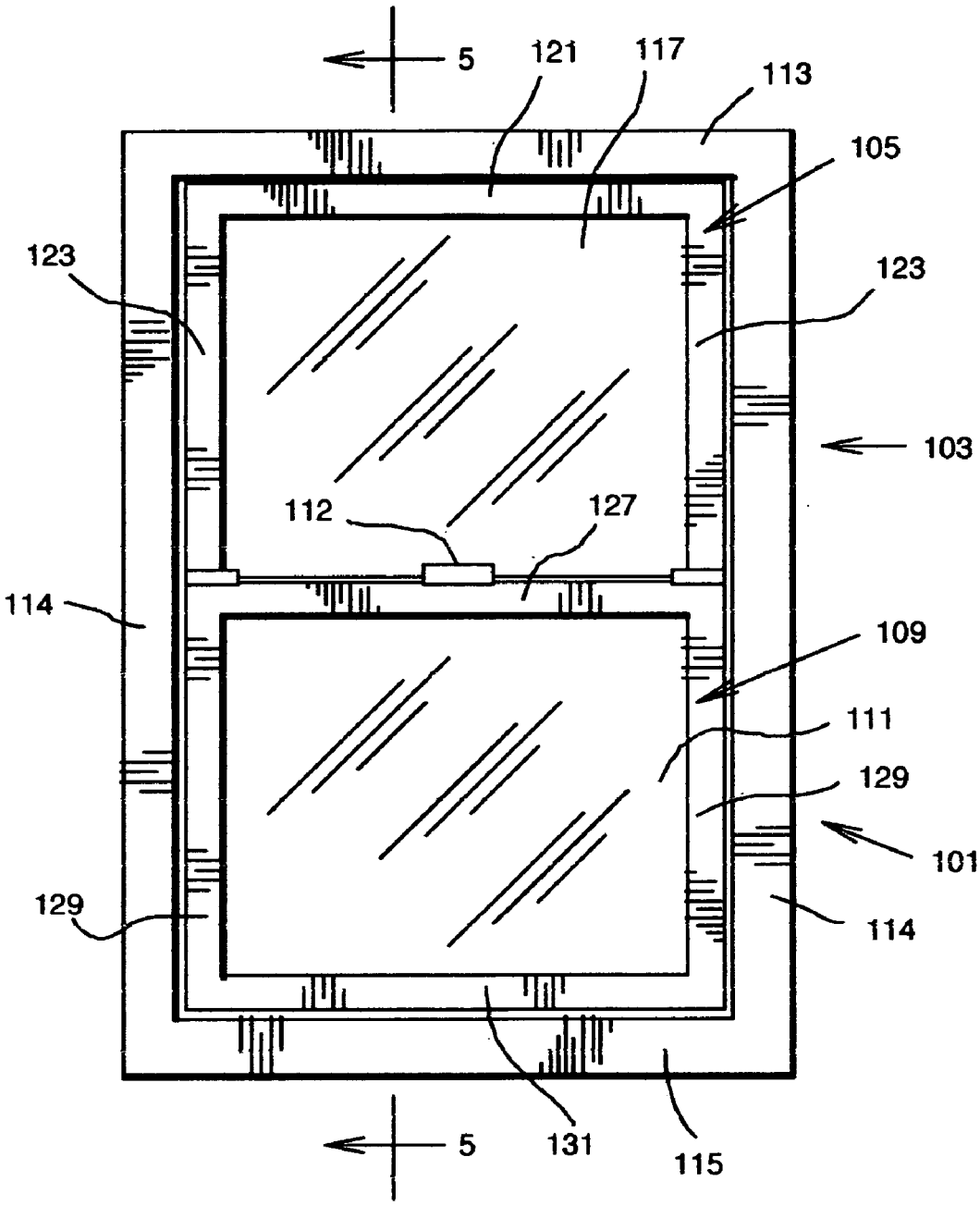

Fig # 5
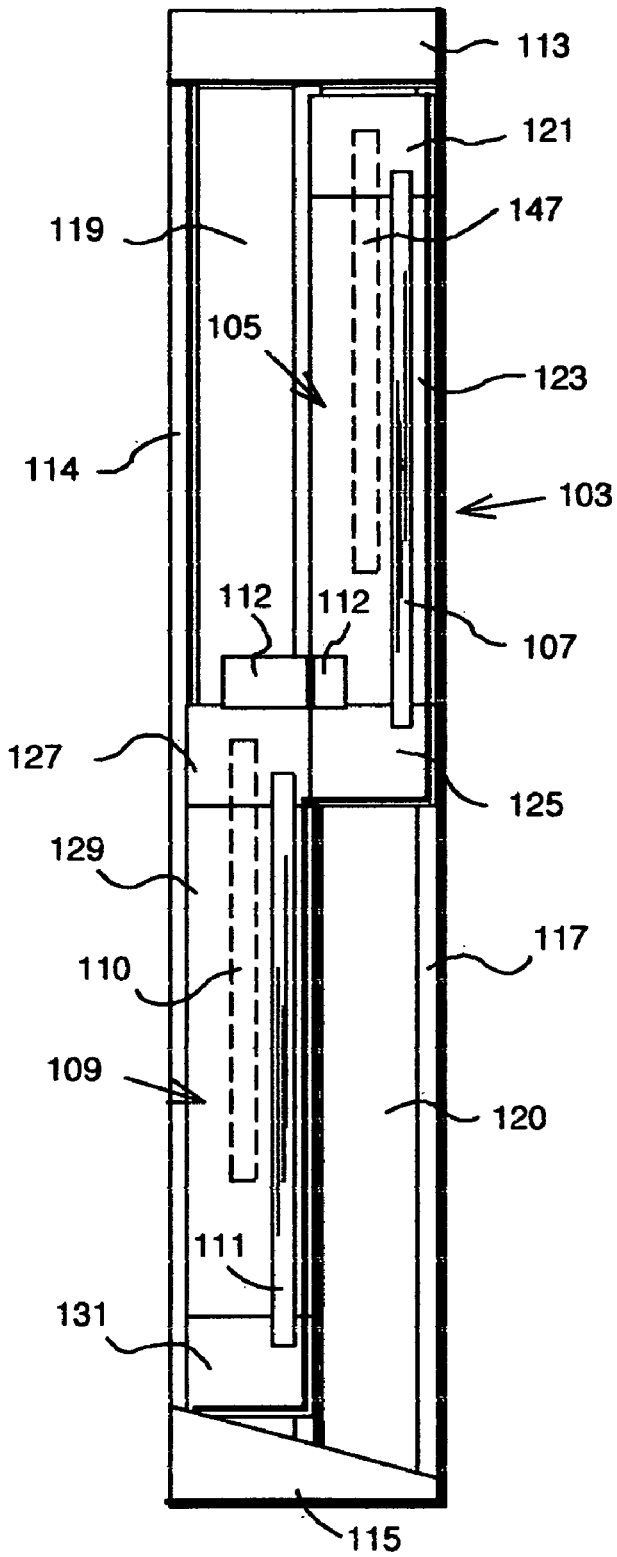

Fig # 6
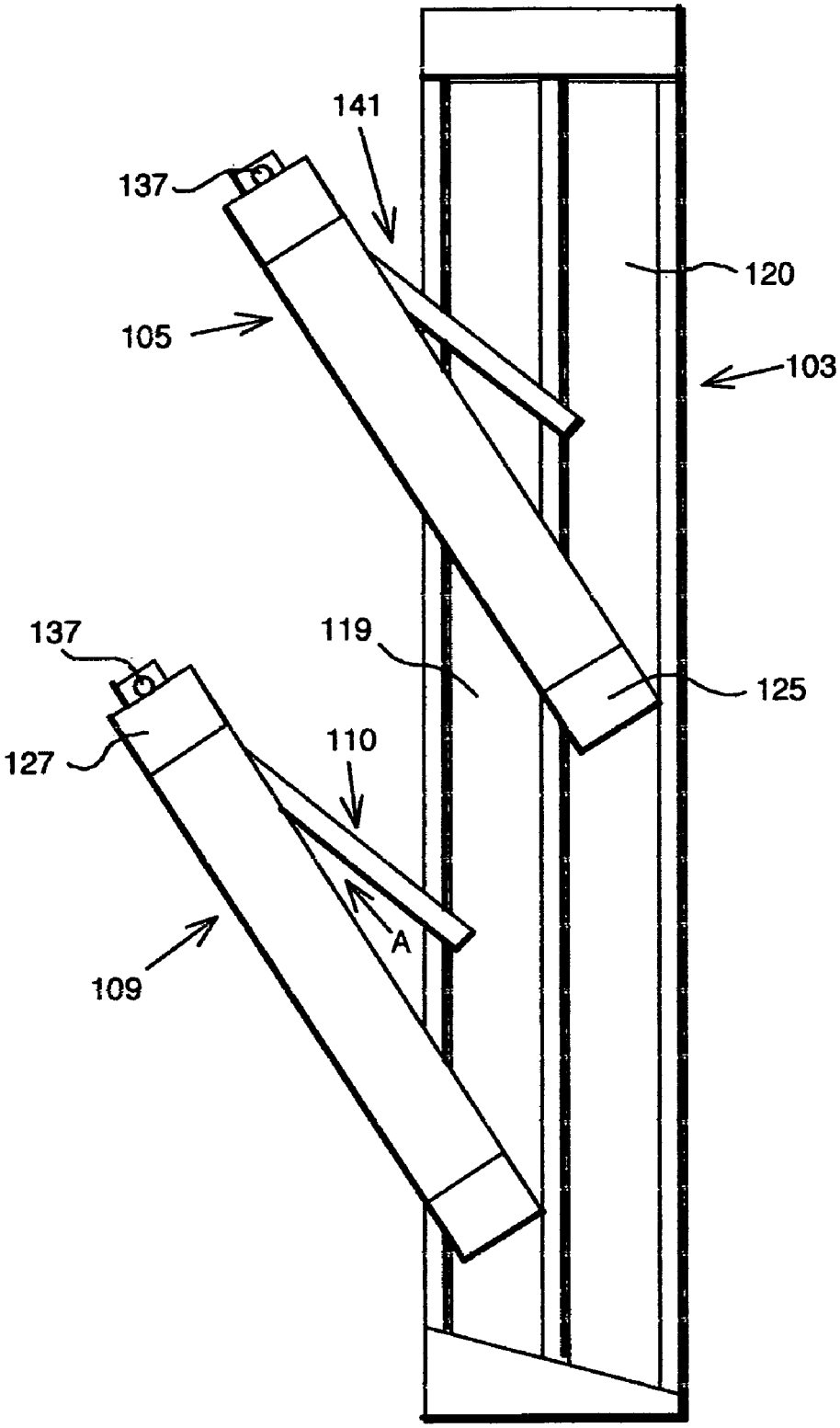

Fig # 7
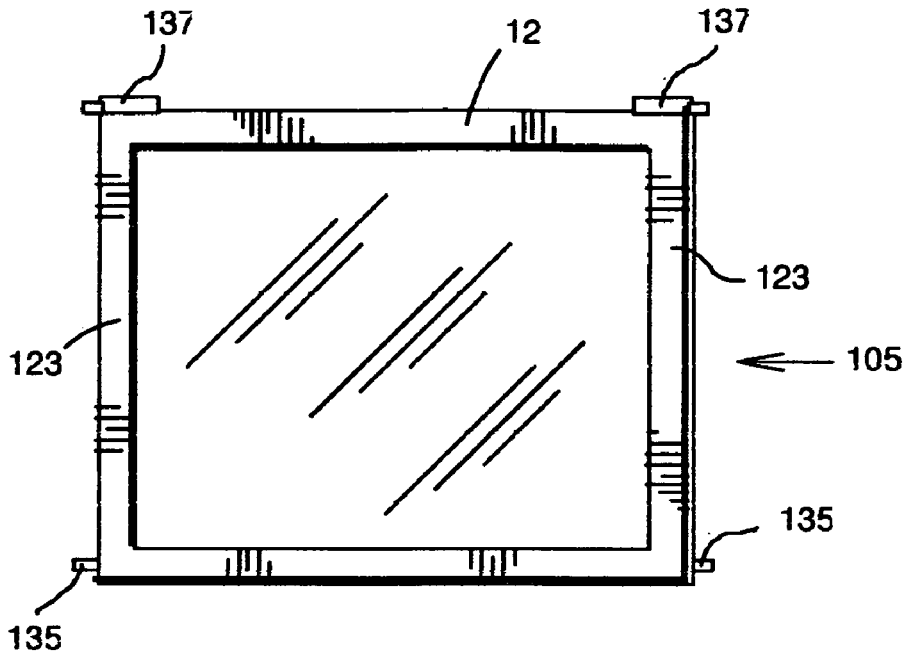
Fig # 8
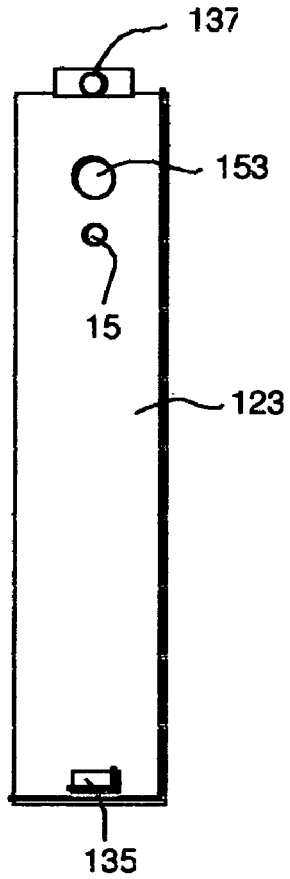
Fig # 9
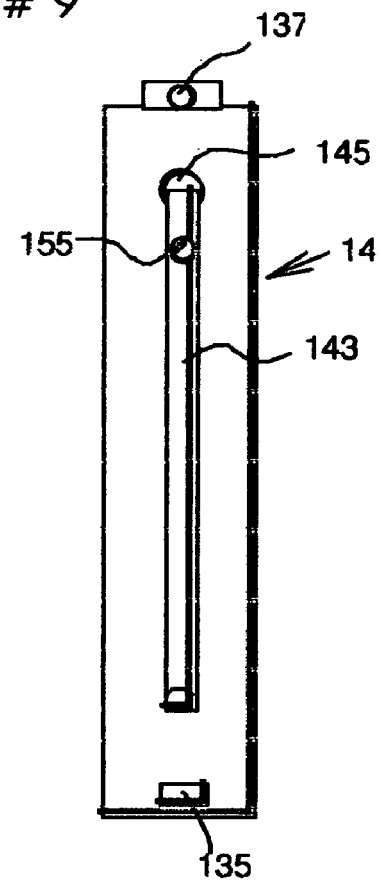

Fig # 10
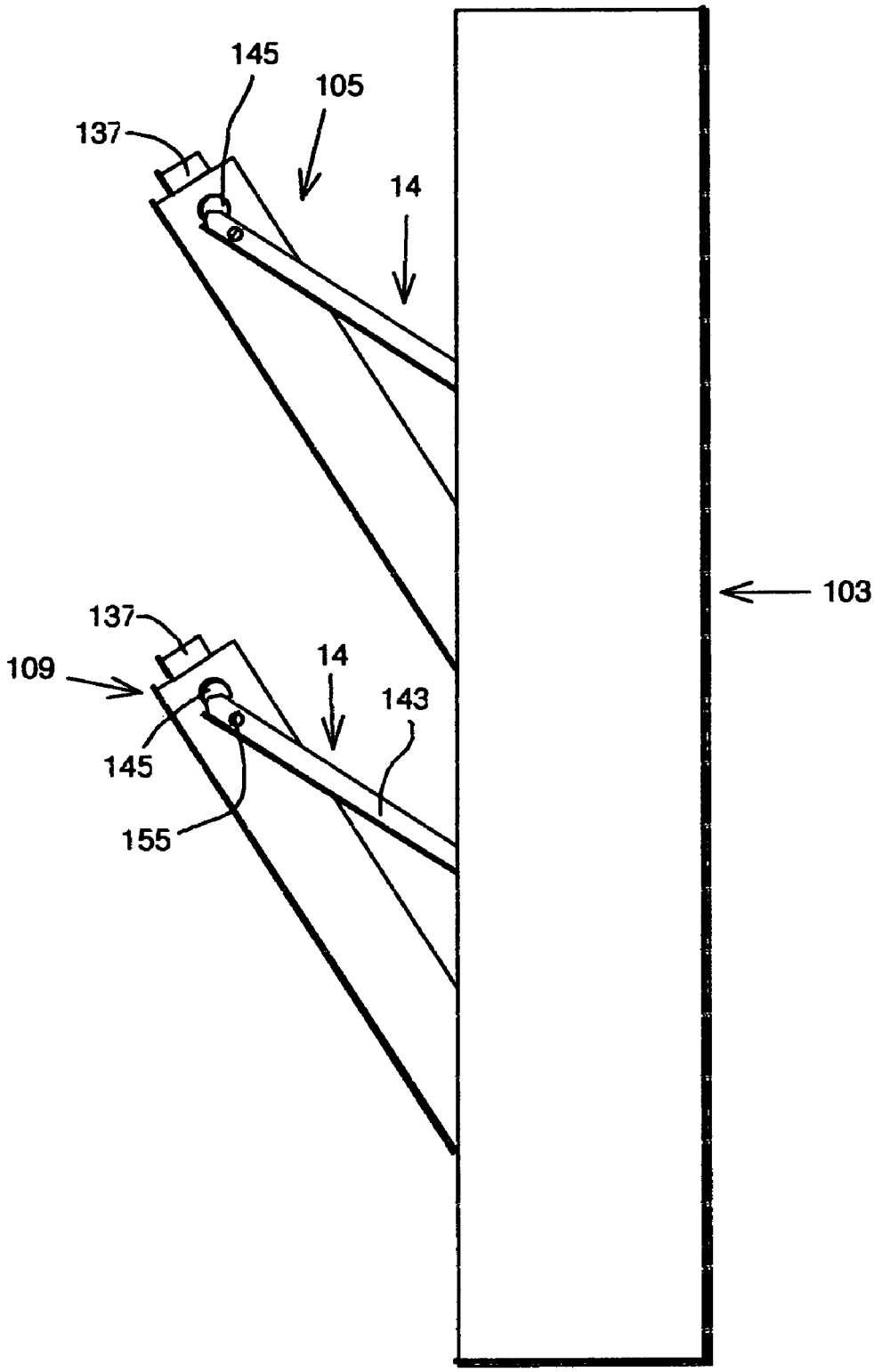

Fig # 11
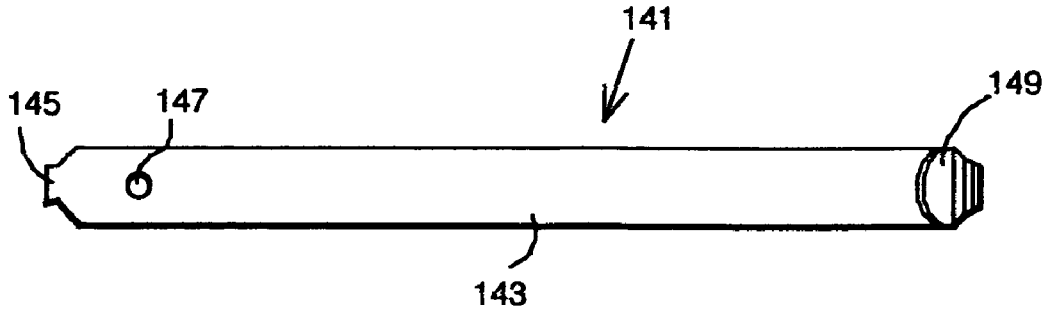
Fig # 12
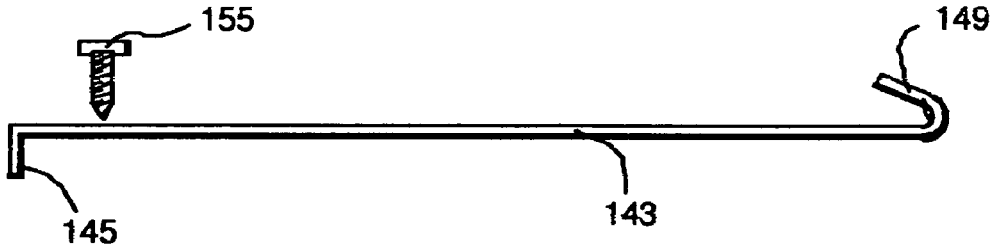
Fig # 13
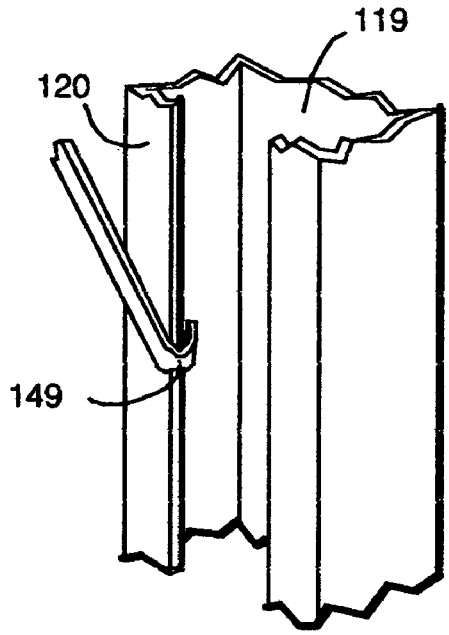

Fig # 14
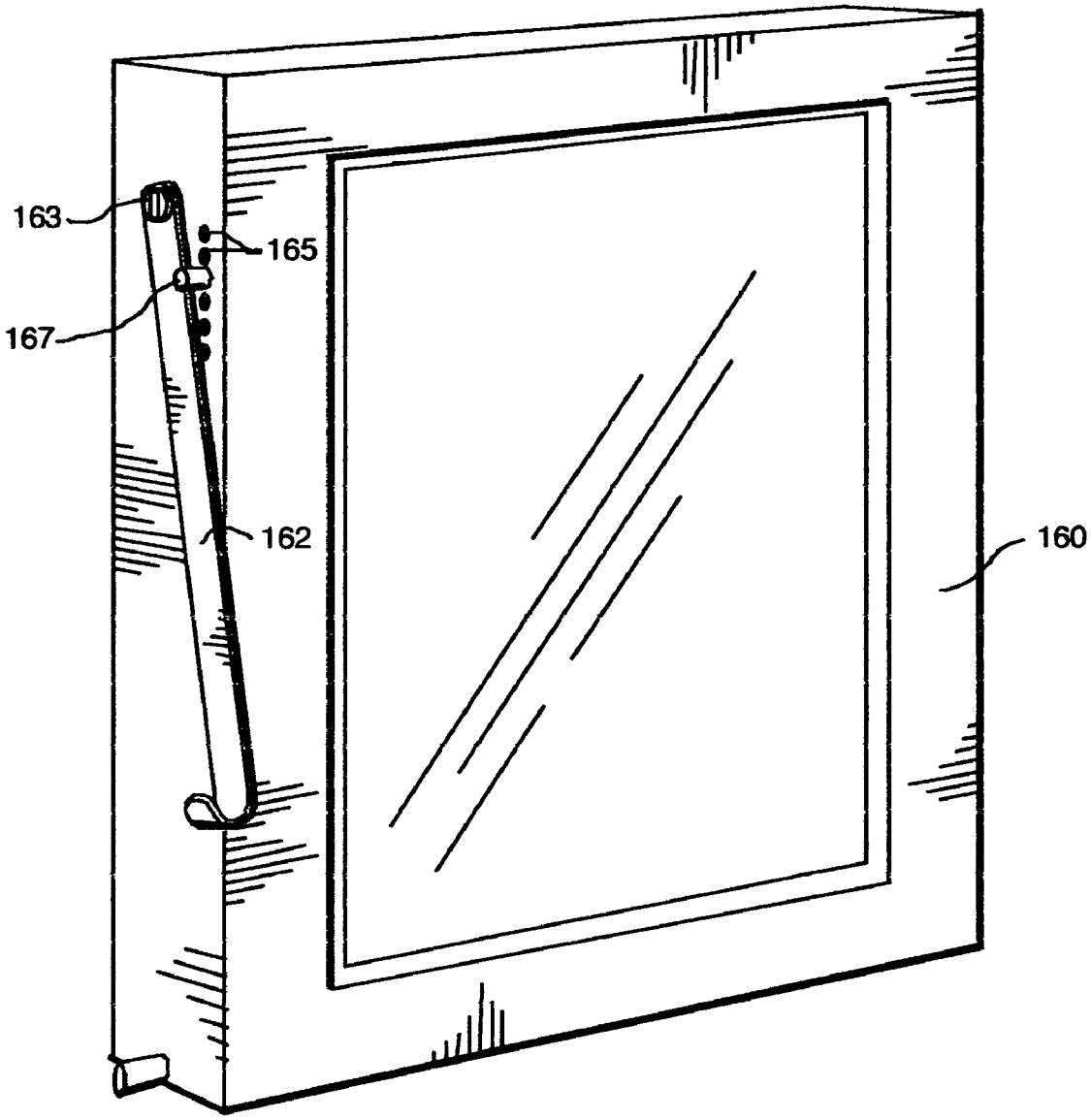

Fig # 15
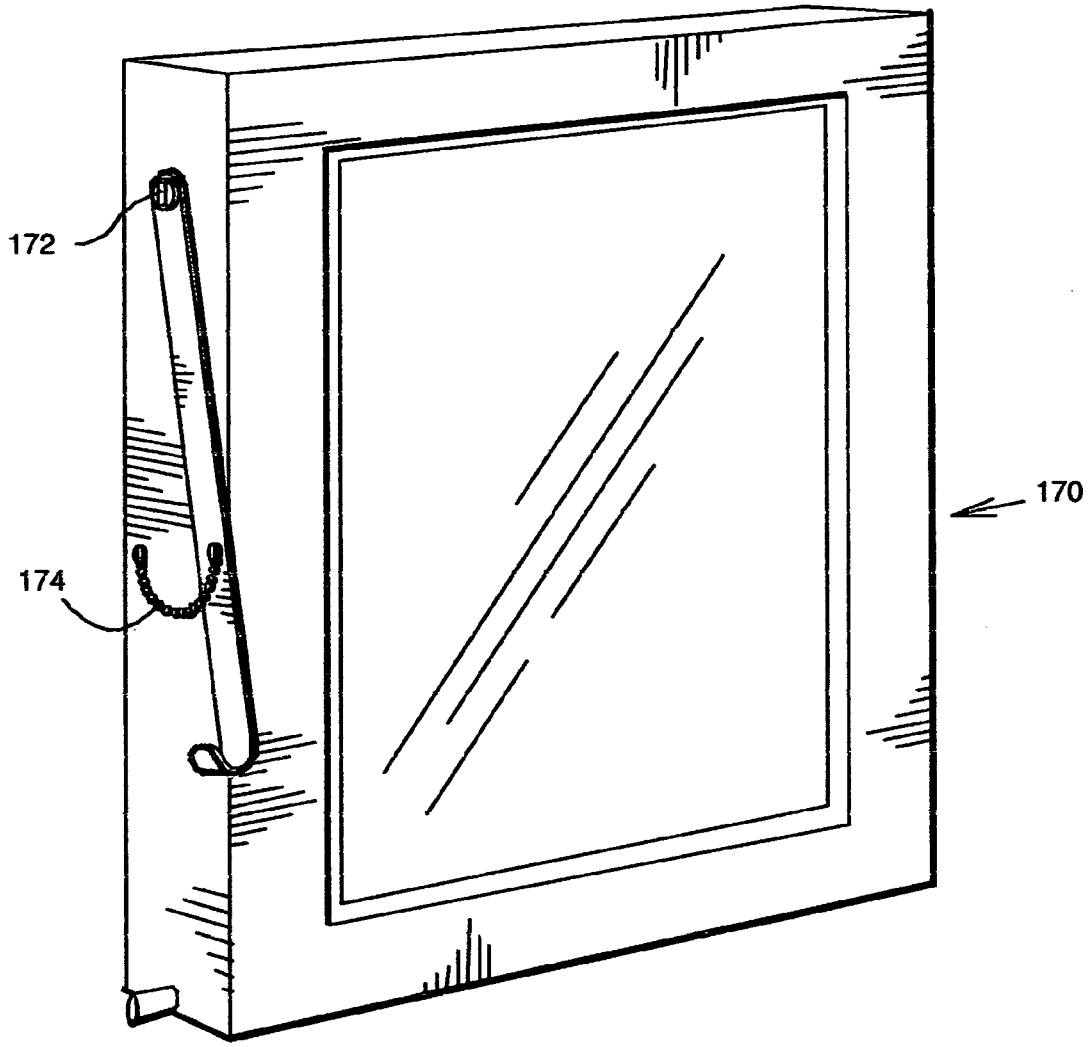

Fig # 16
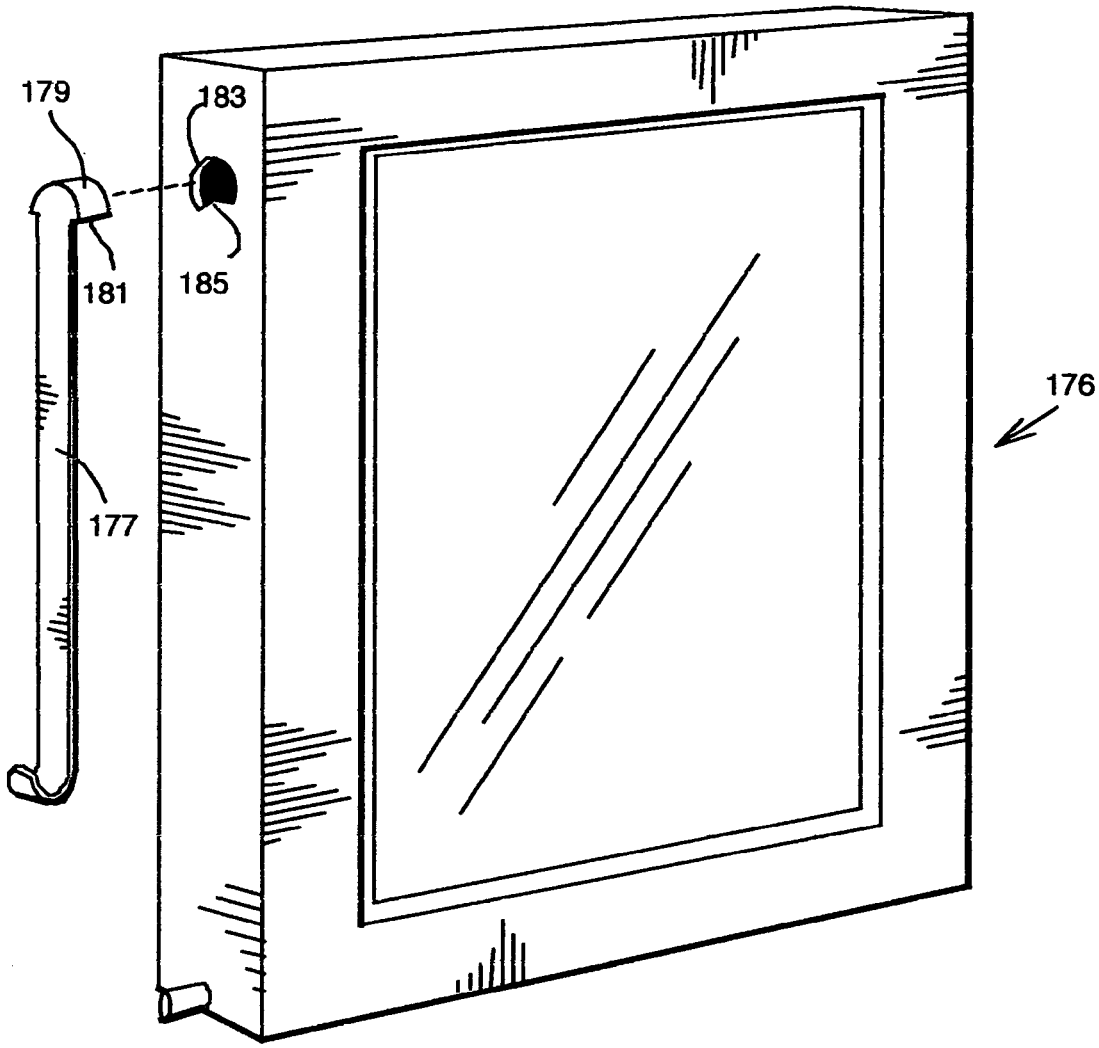

Fig # 17
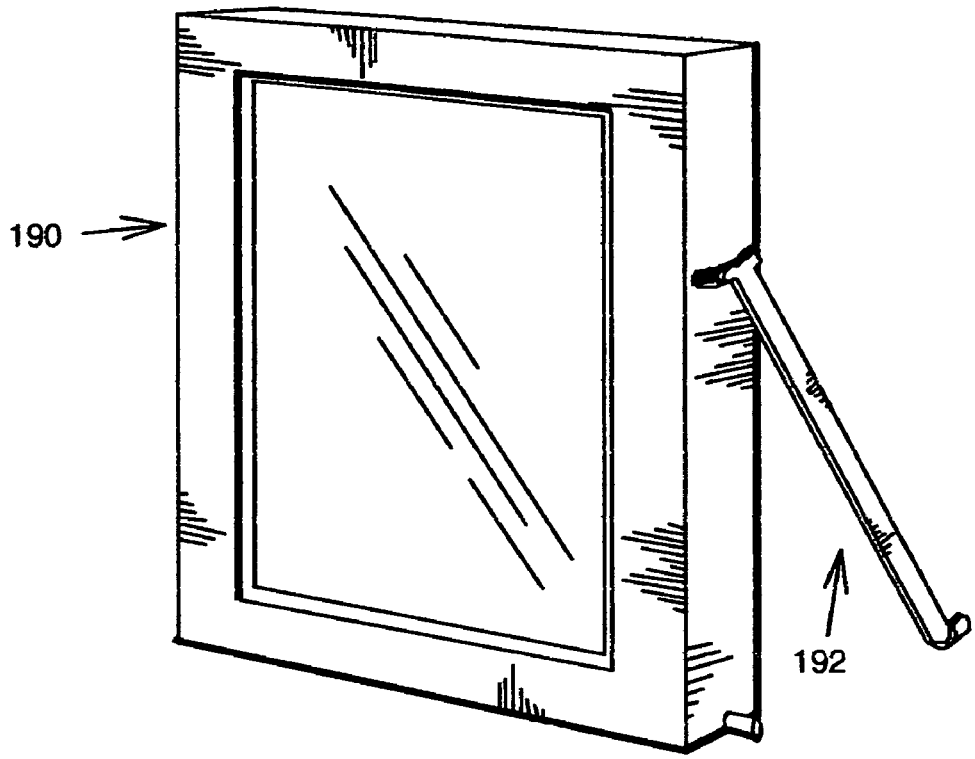
Fig # 18
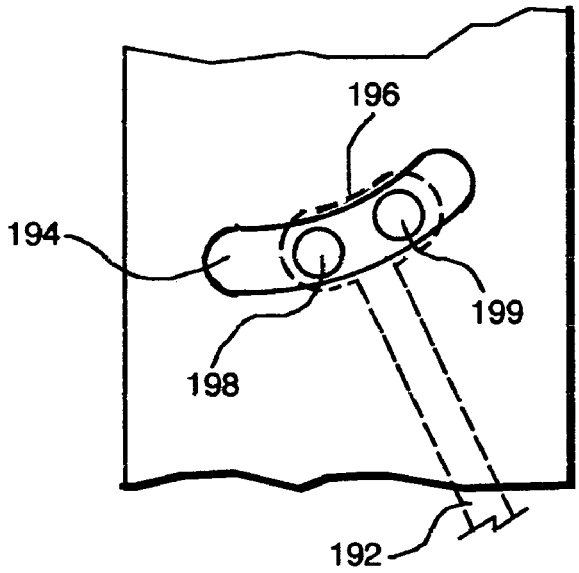

Fig # 19
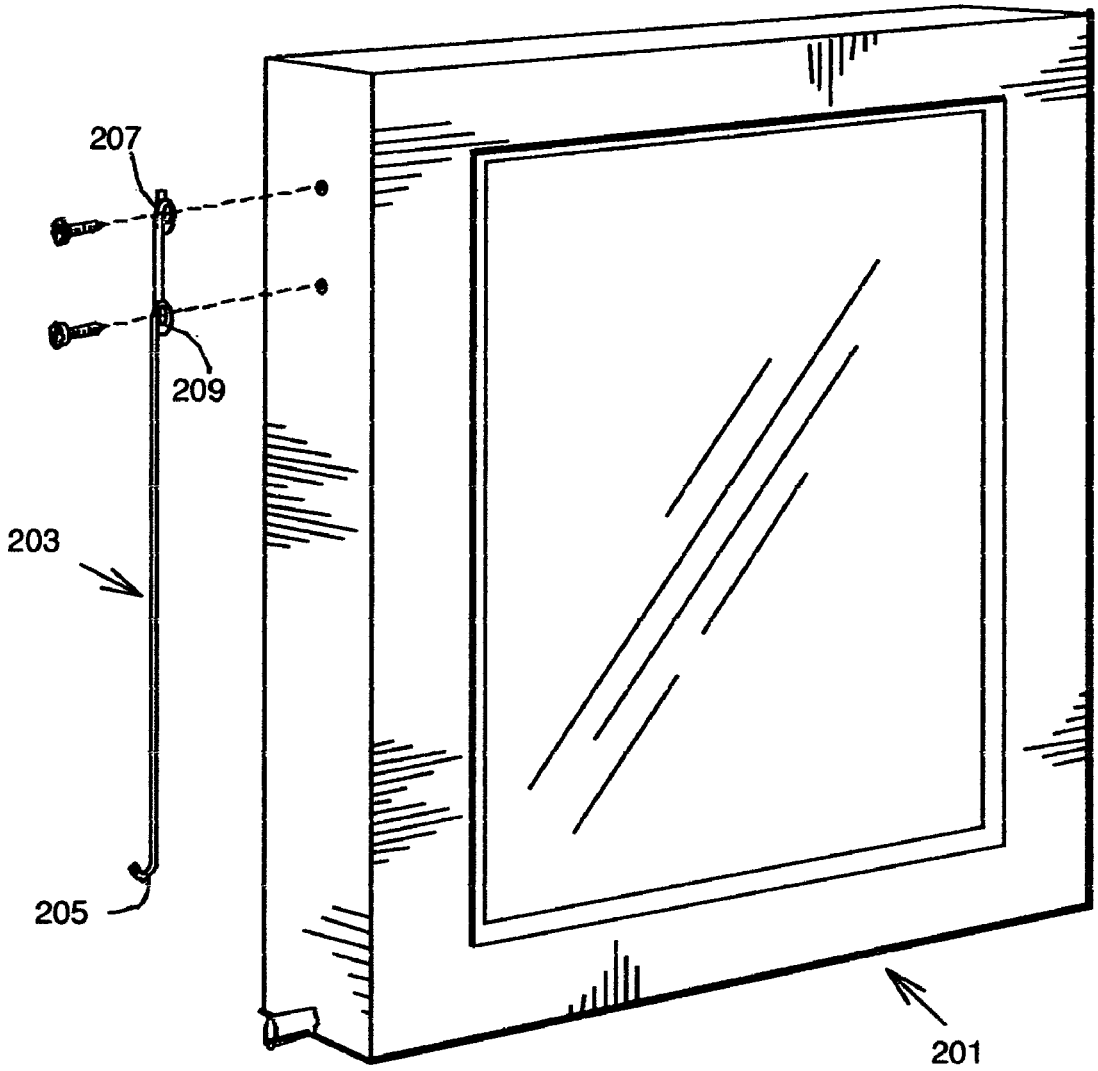

Fig # 20
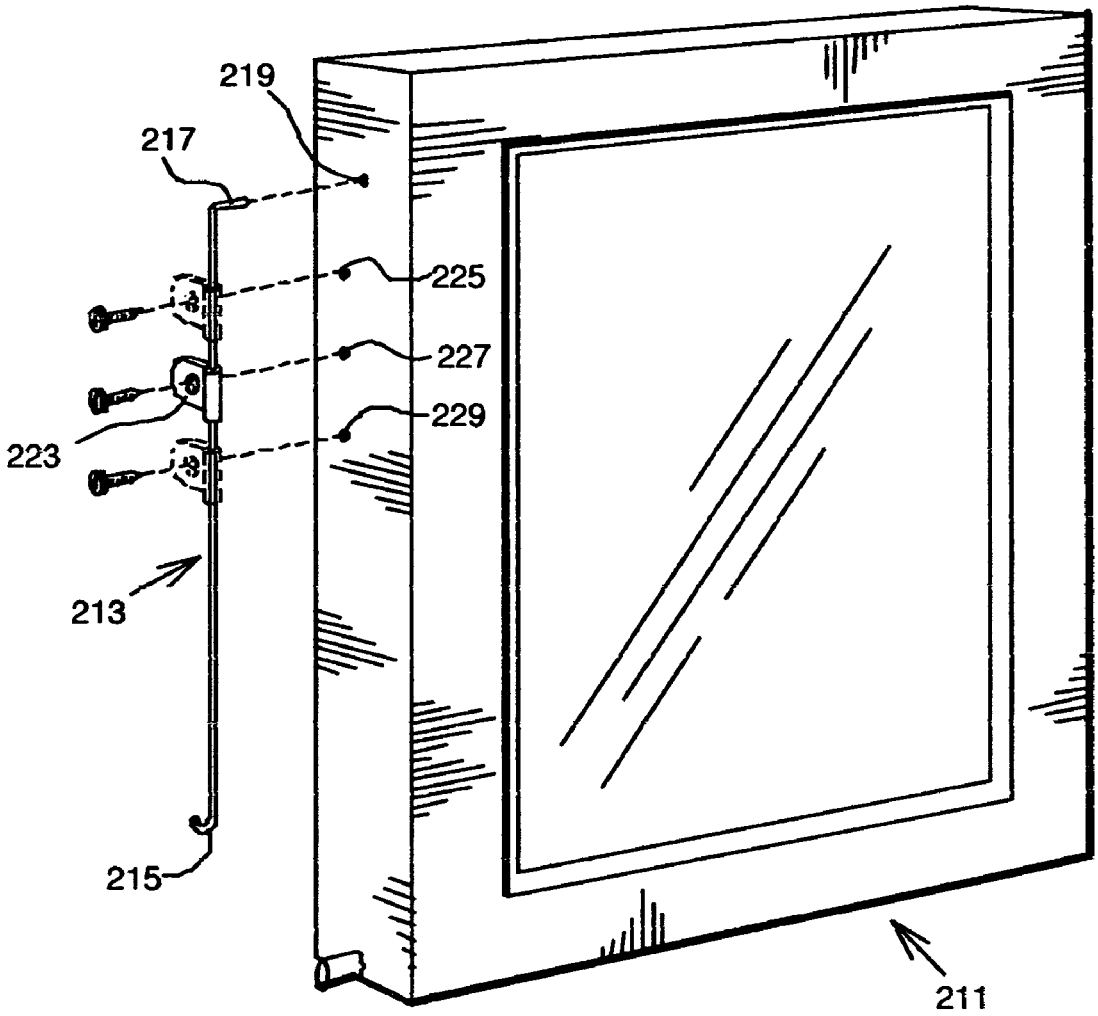

Fig # 21
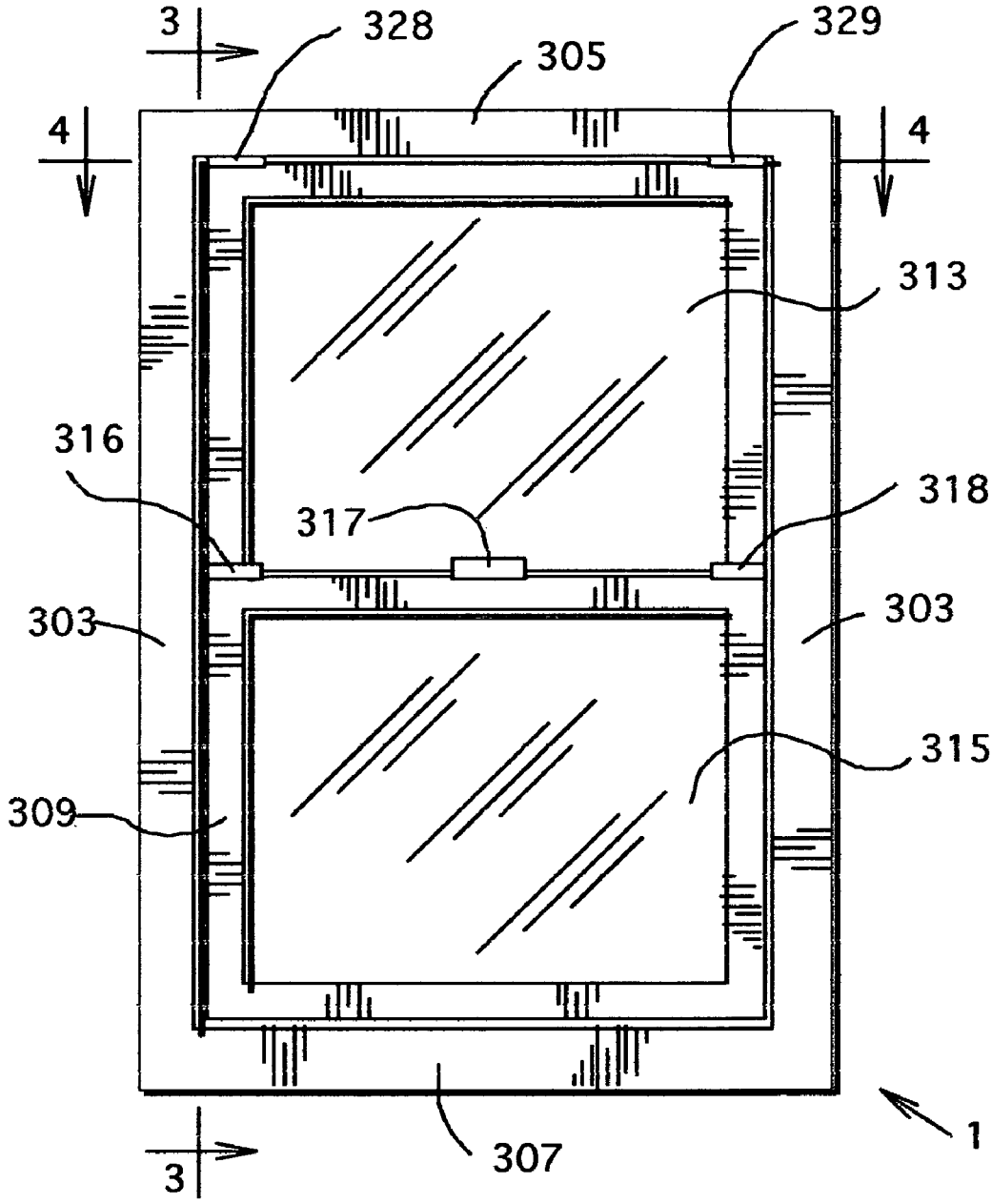

Fig # 22
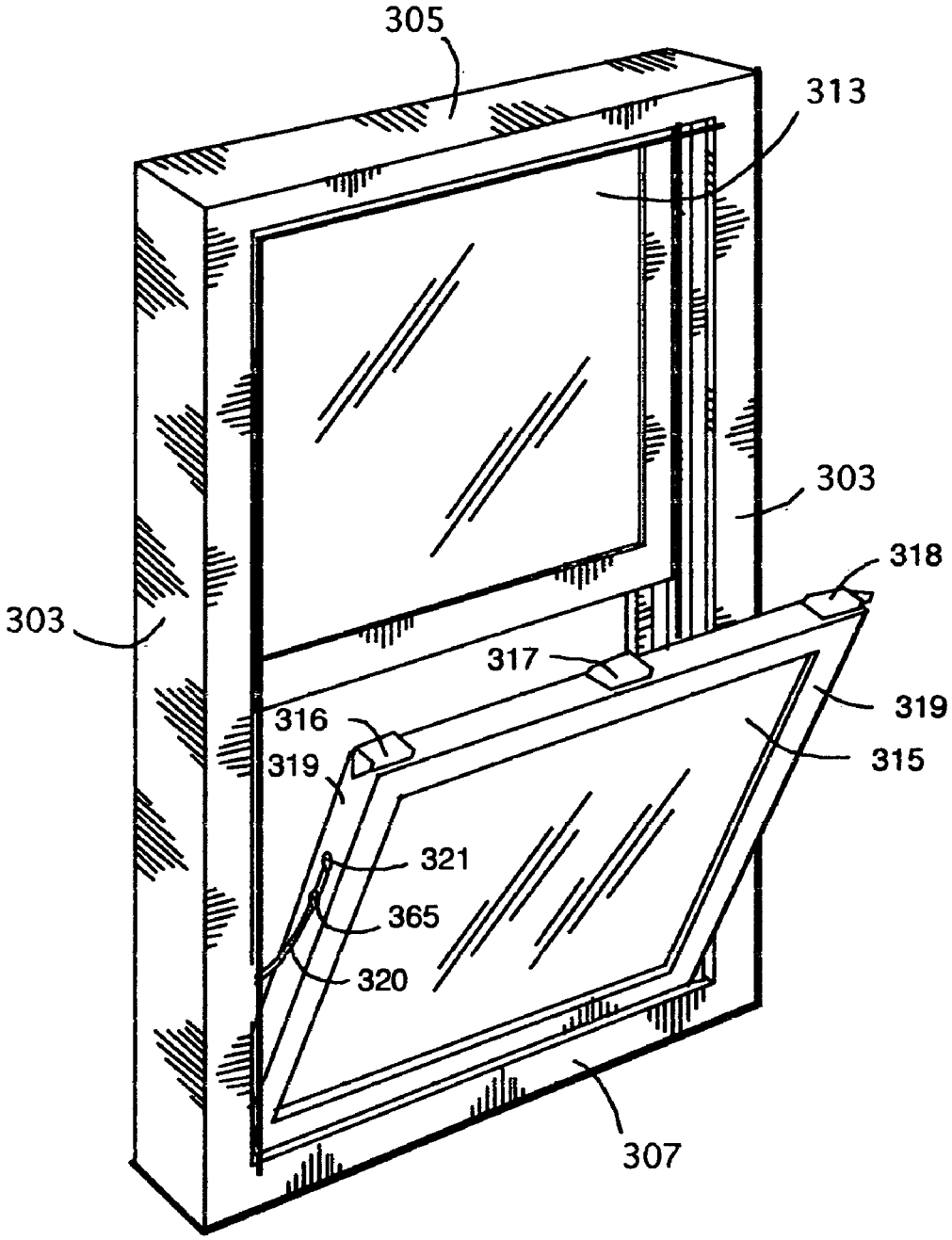

Fig # 23
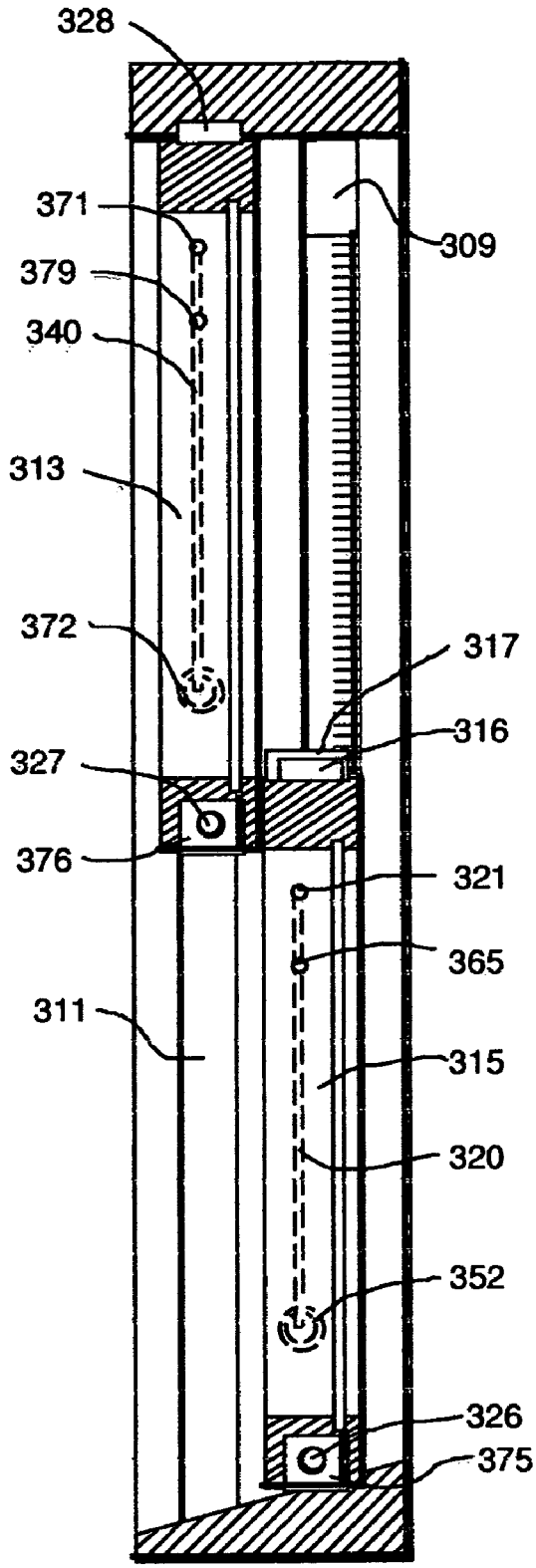

Fig # 24
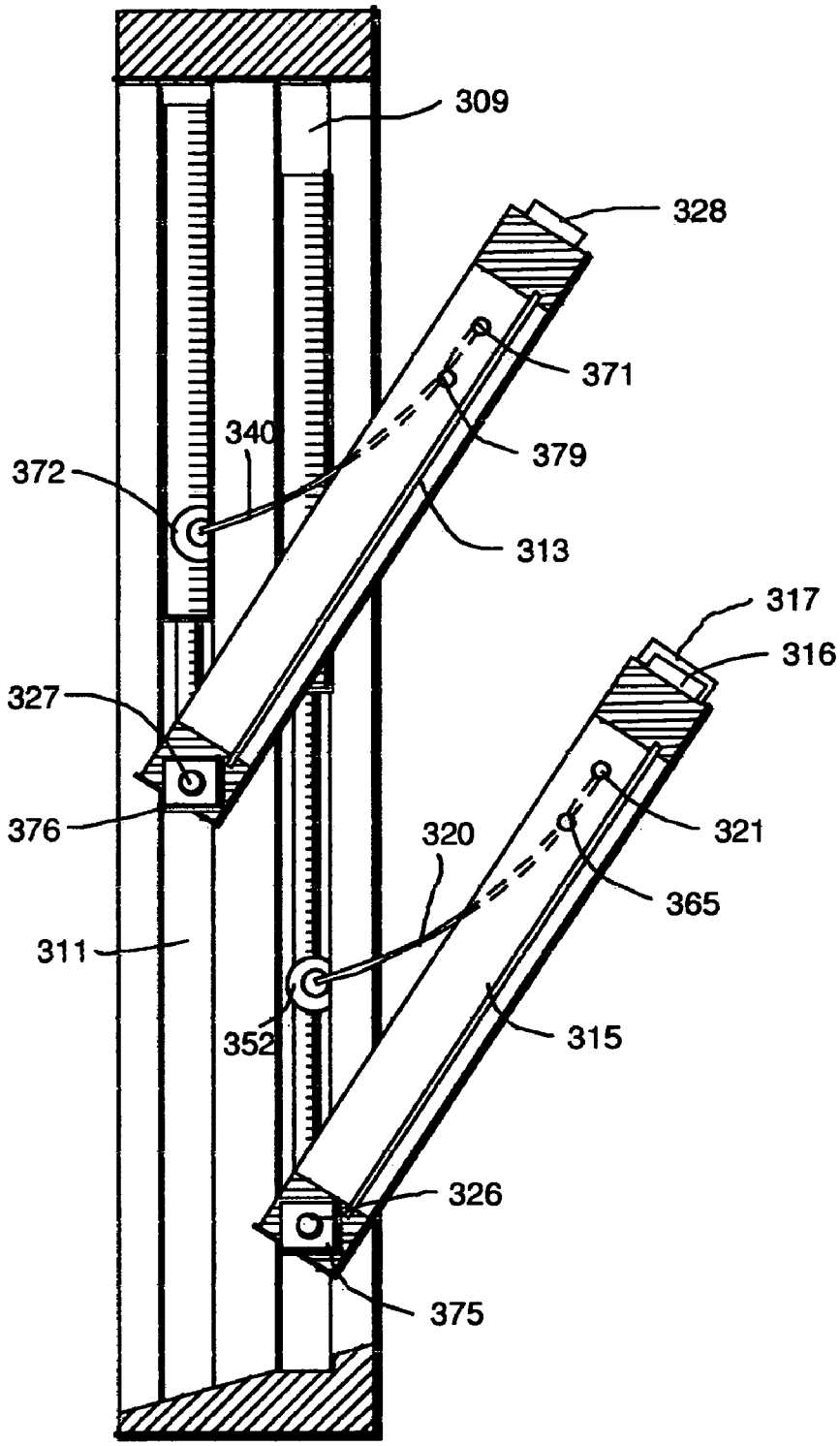

Fig # 25
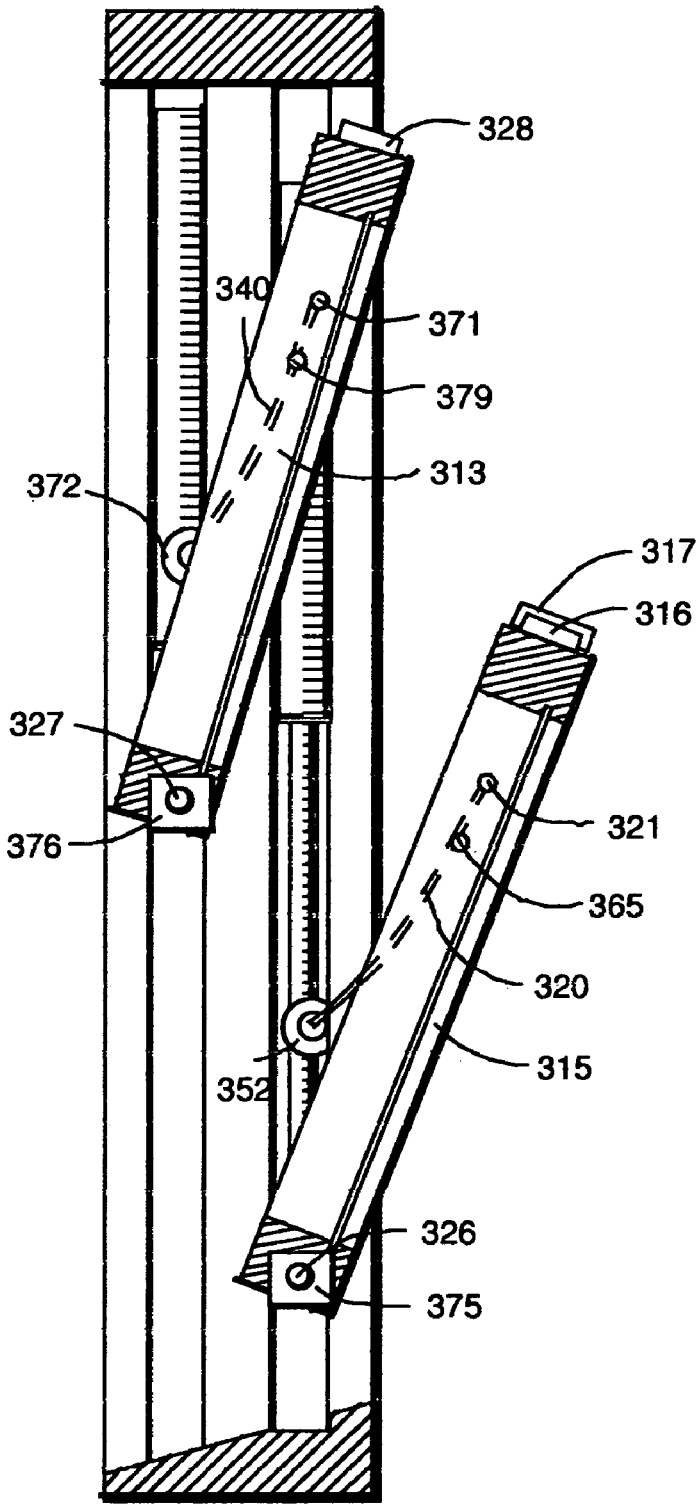

Fig # 26
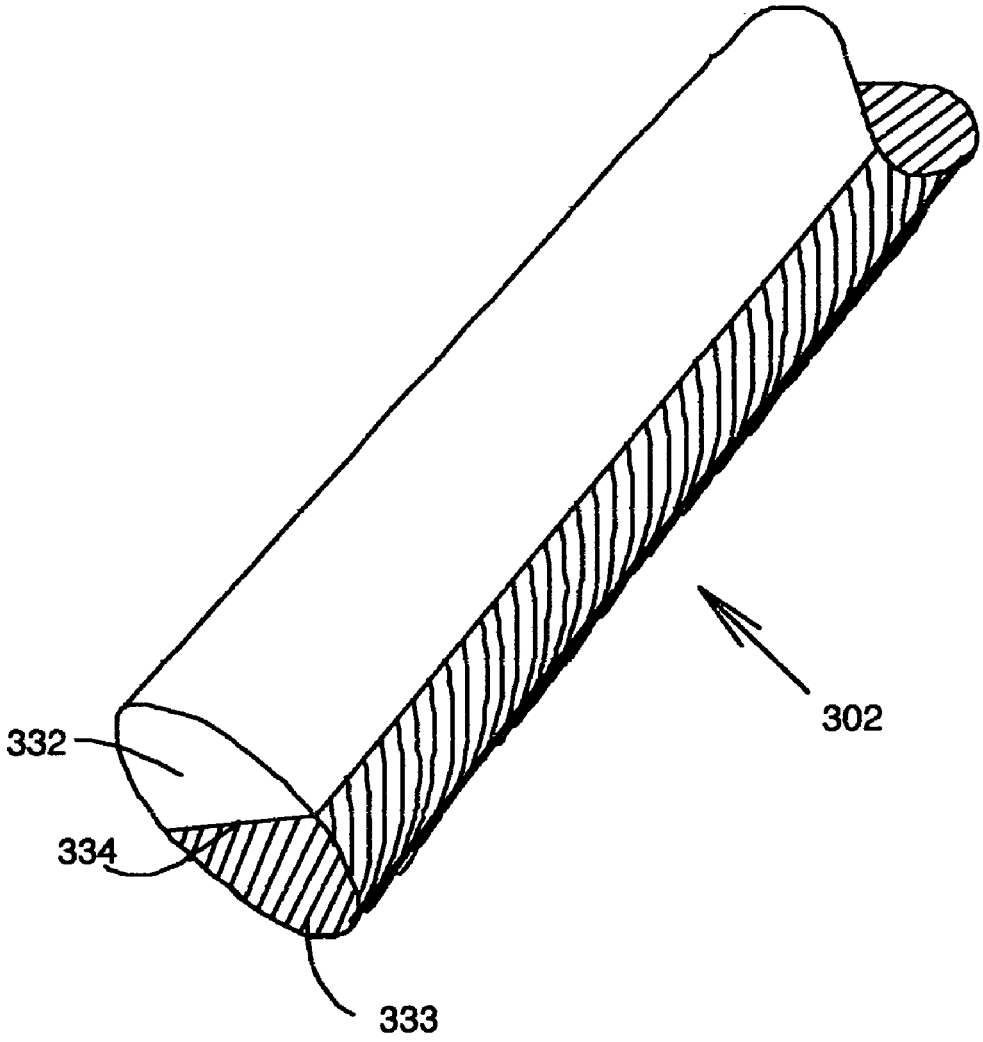

Fig # 27
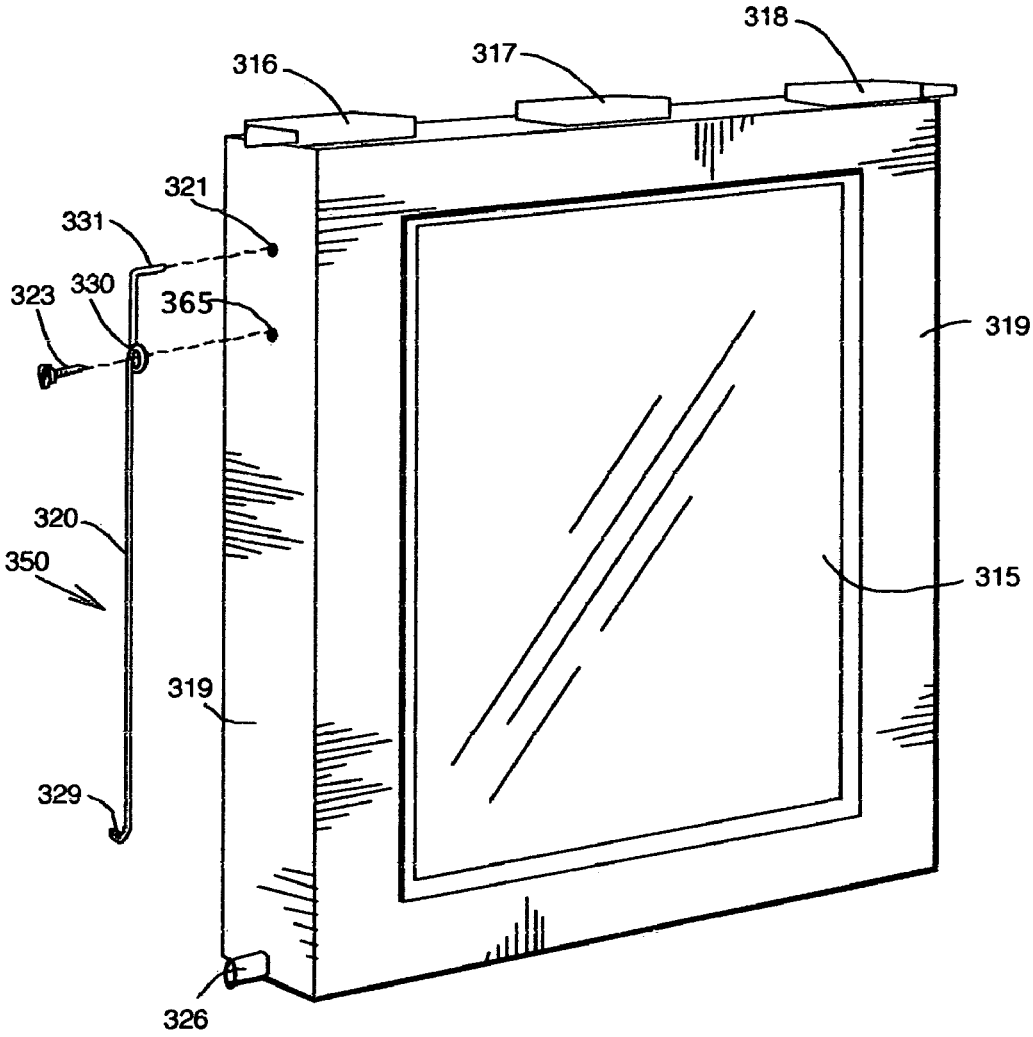

Fig # 28
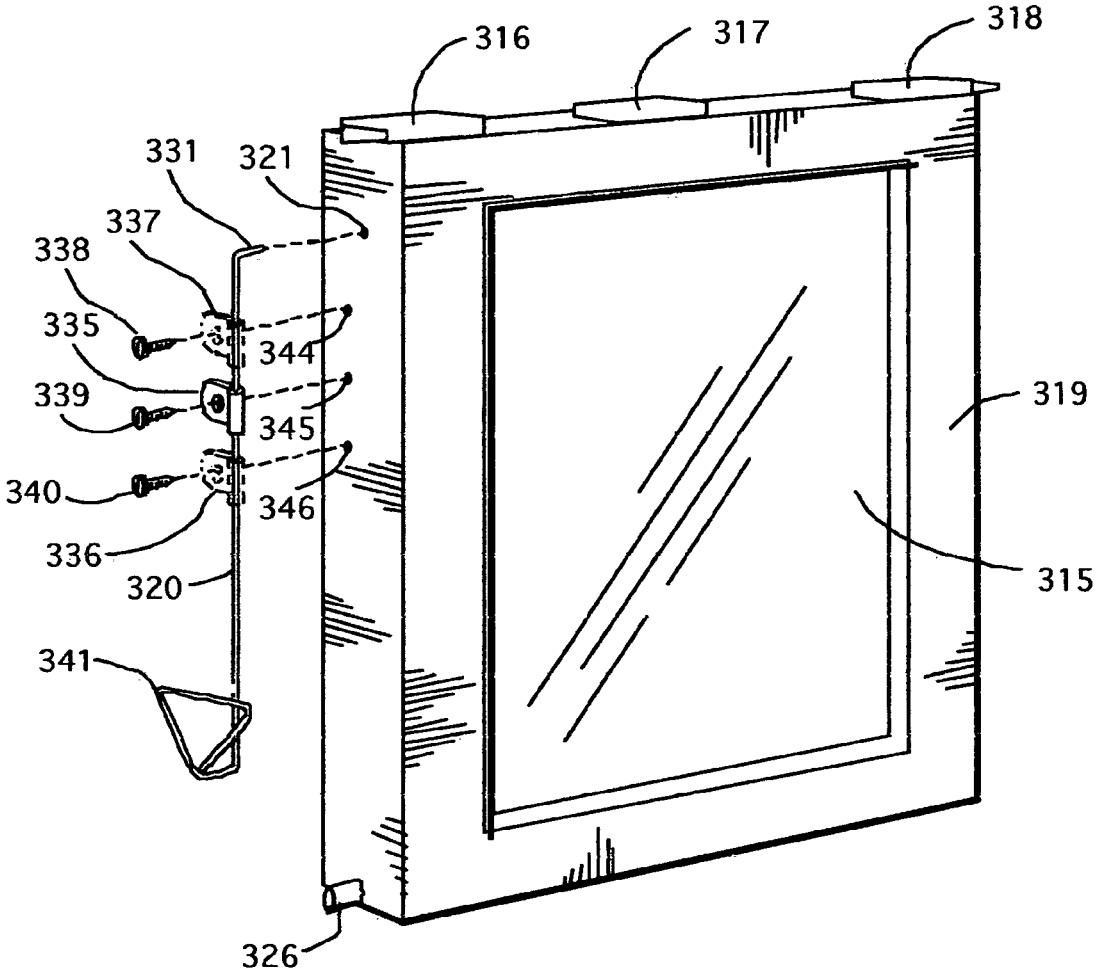

Fig # 29
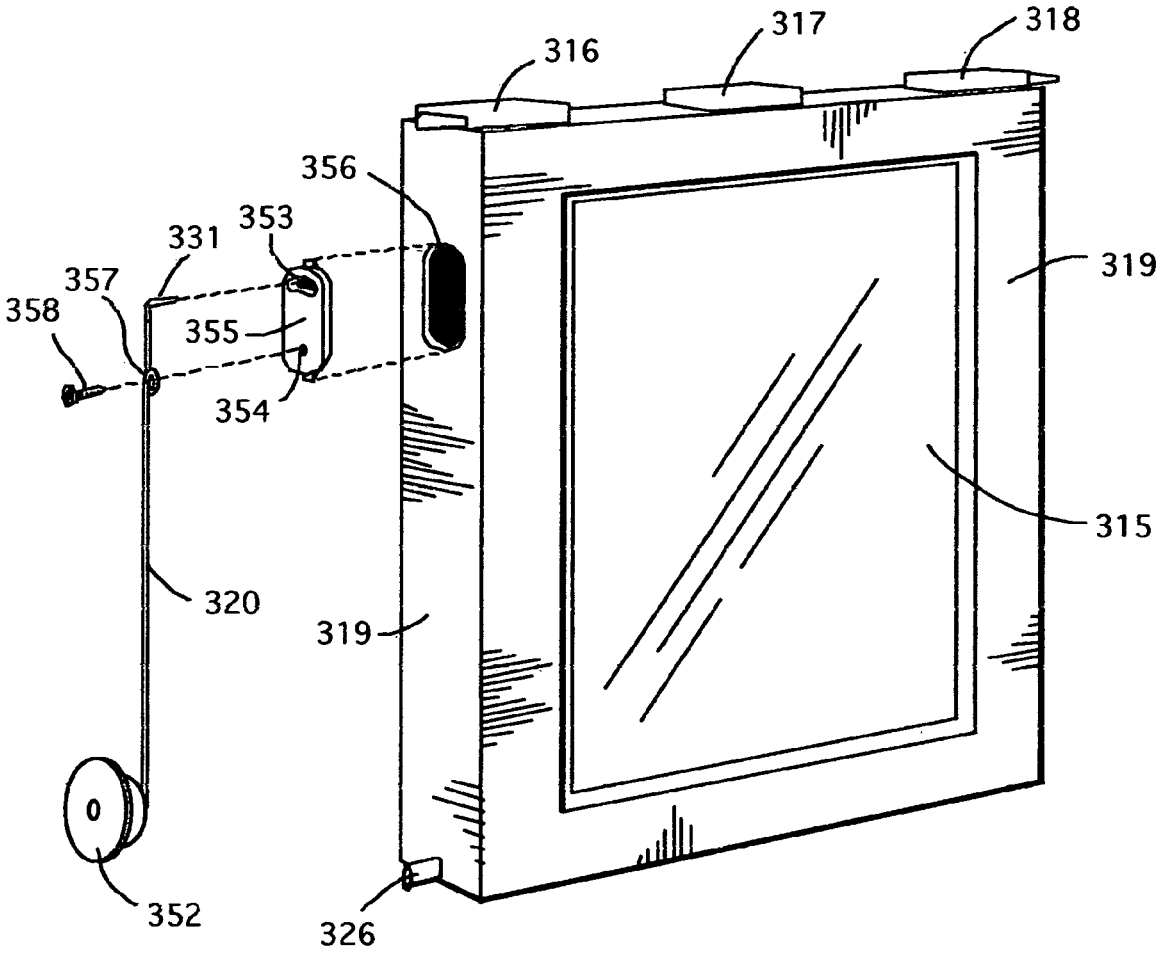

Fig # 30
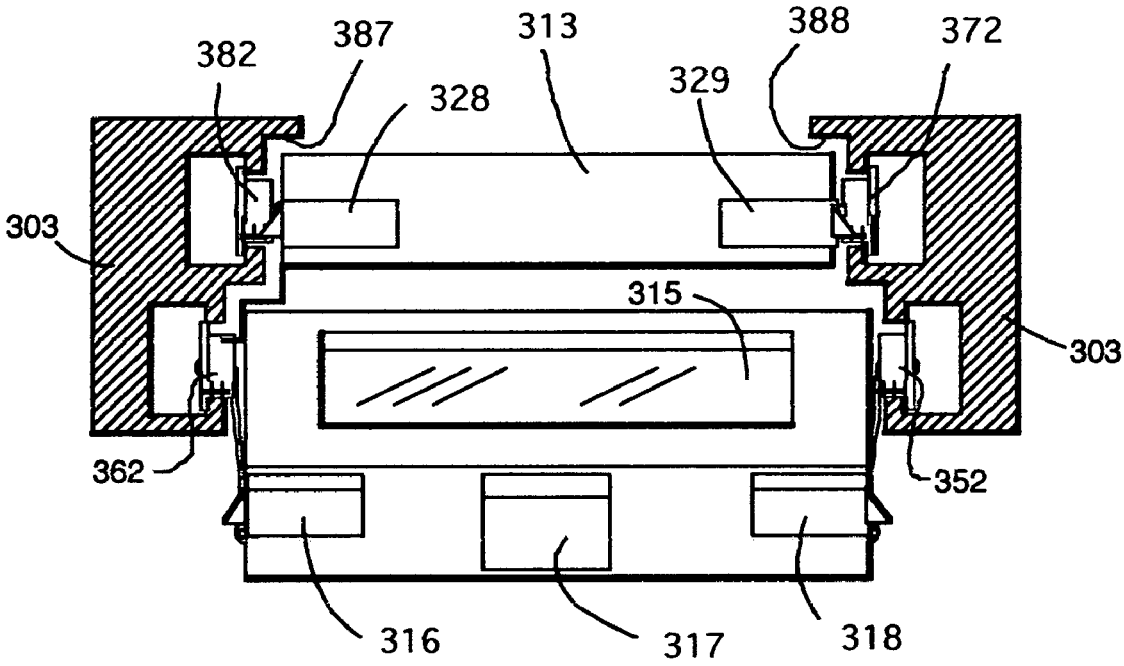

Fig # 31
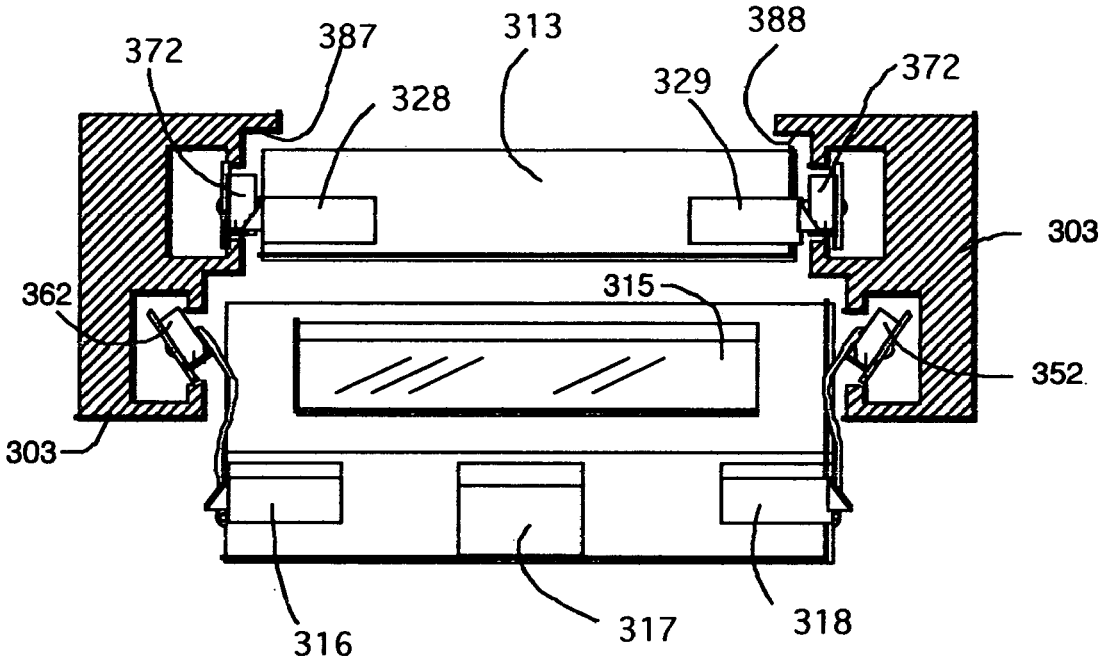

Fig # 32
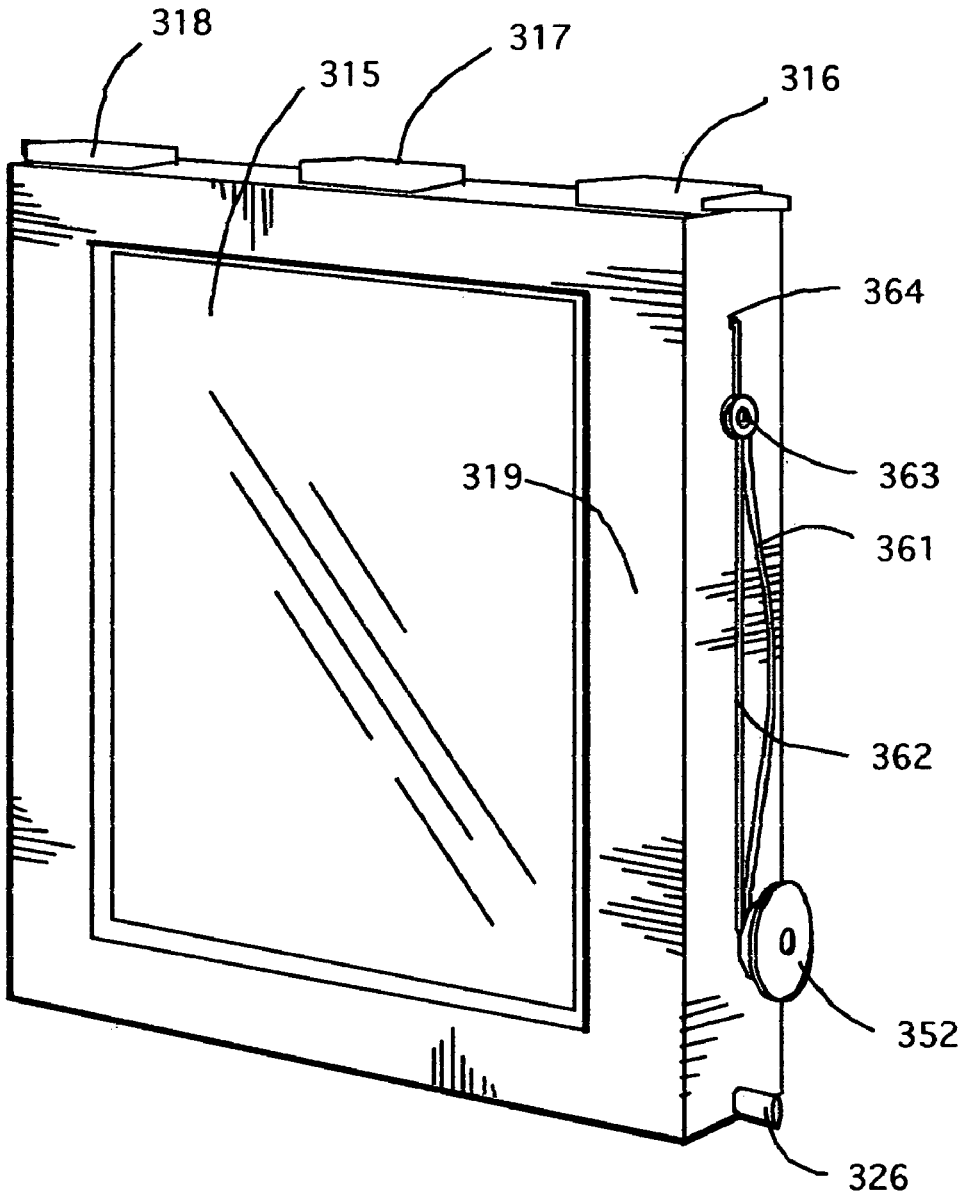

Fig # 33
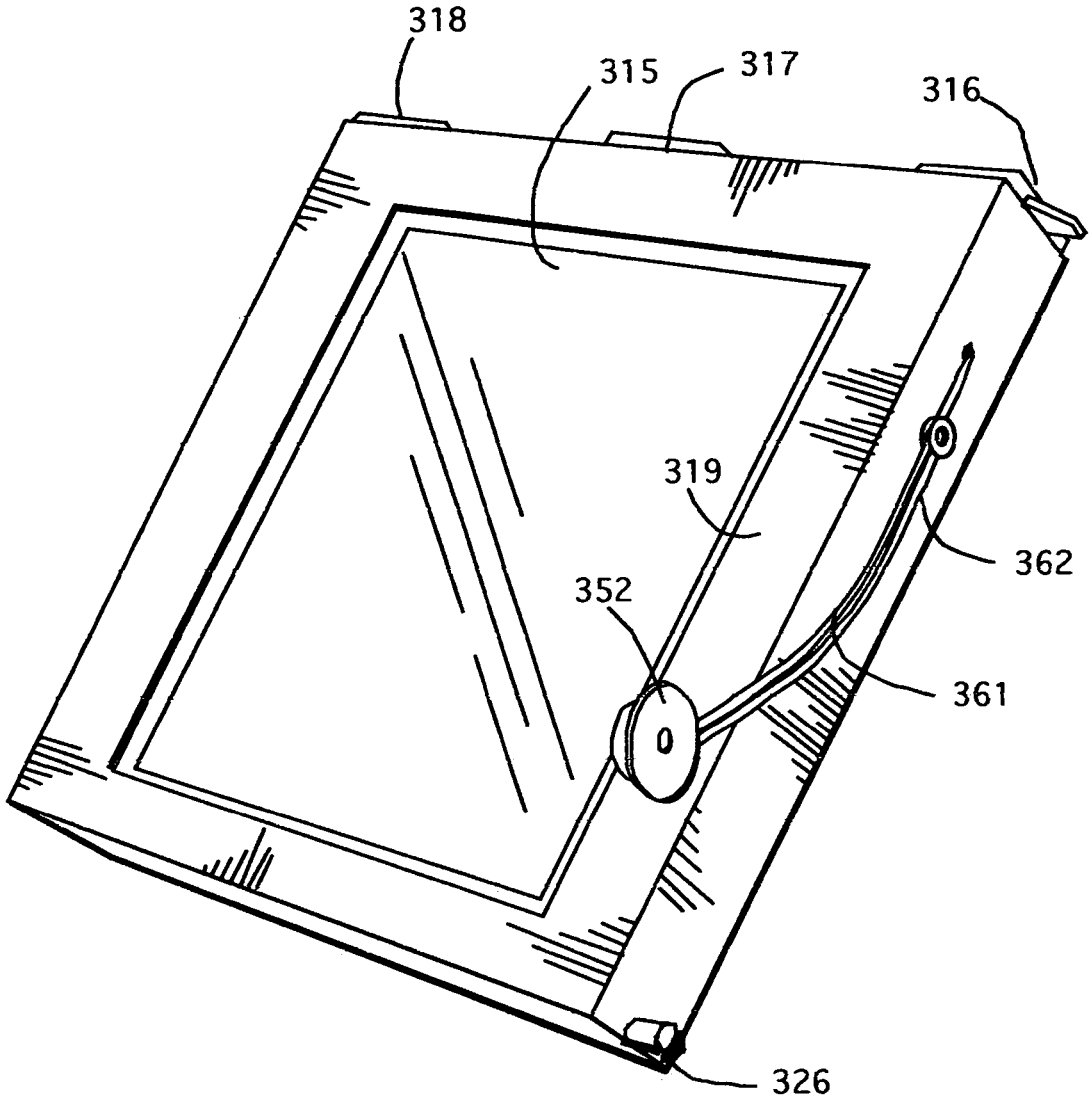

Fig # 34
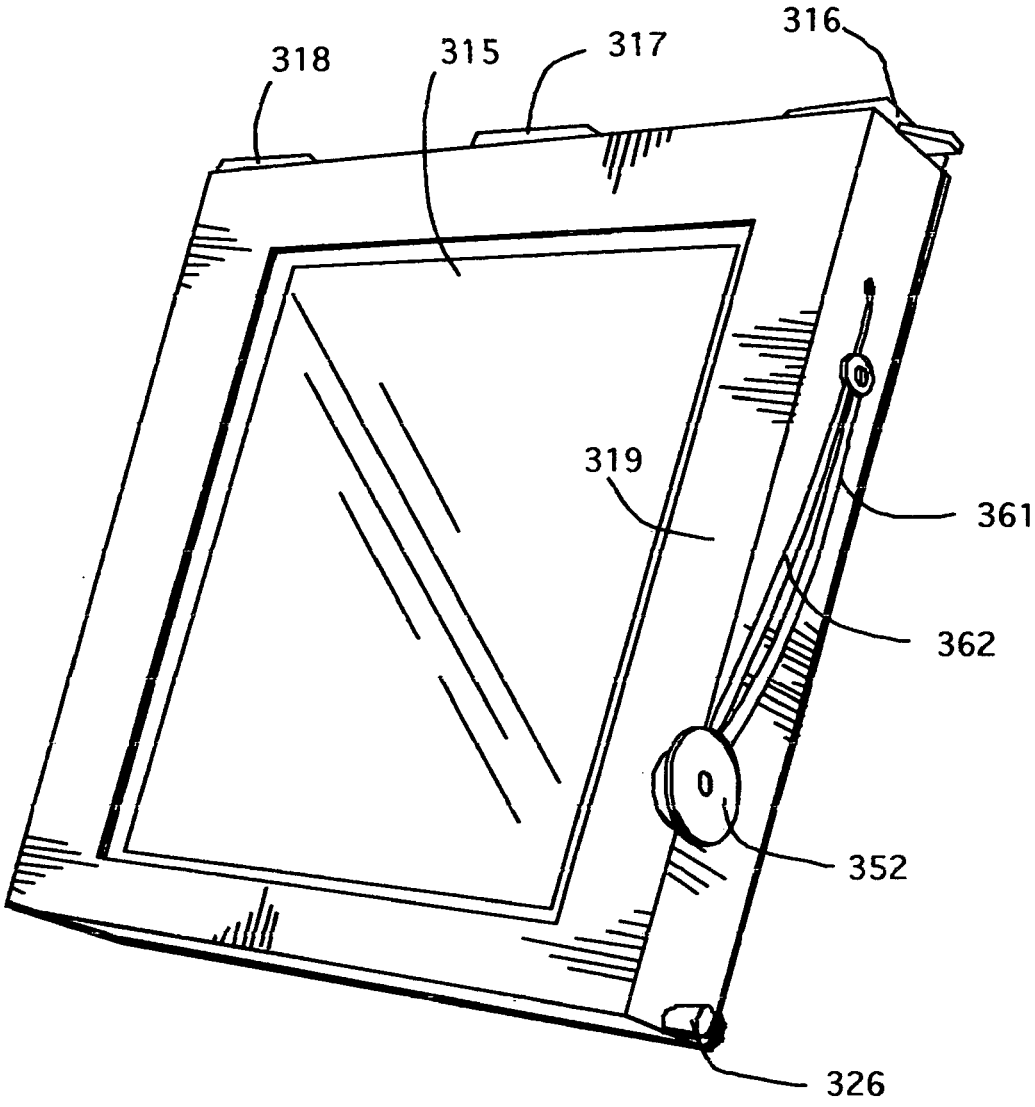

Fig # 35
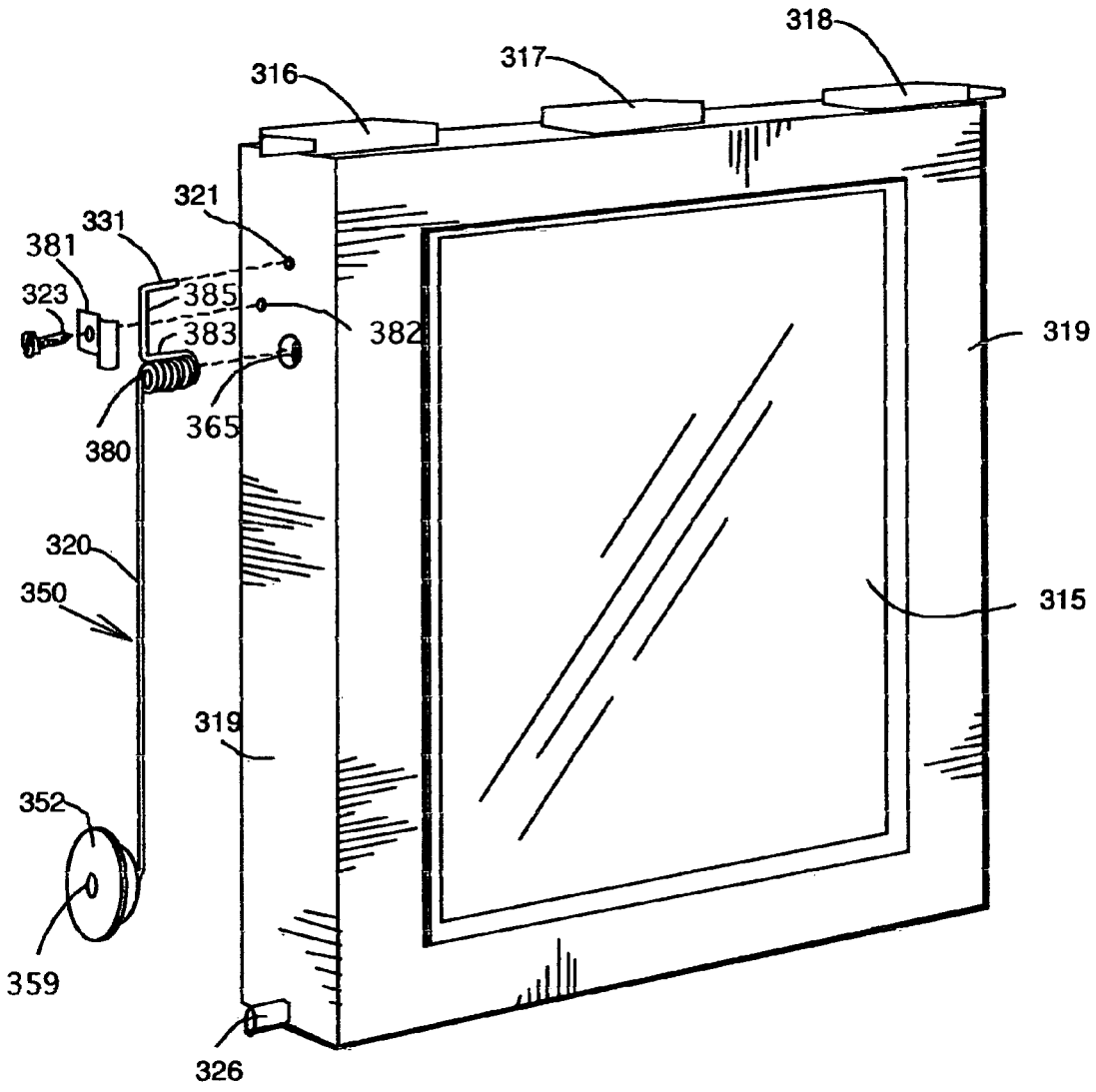

FIG. #36
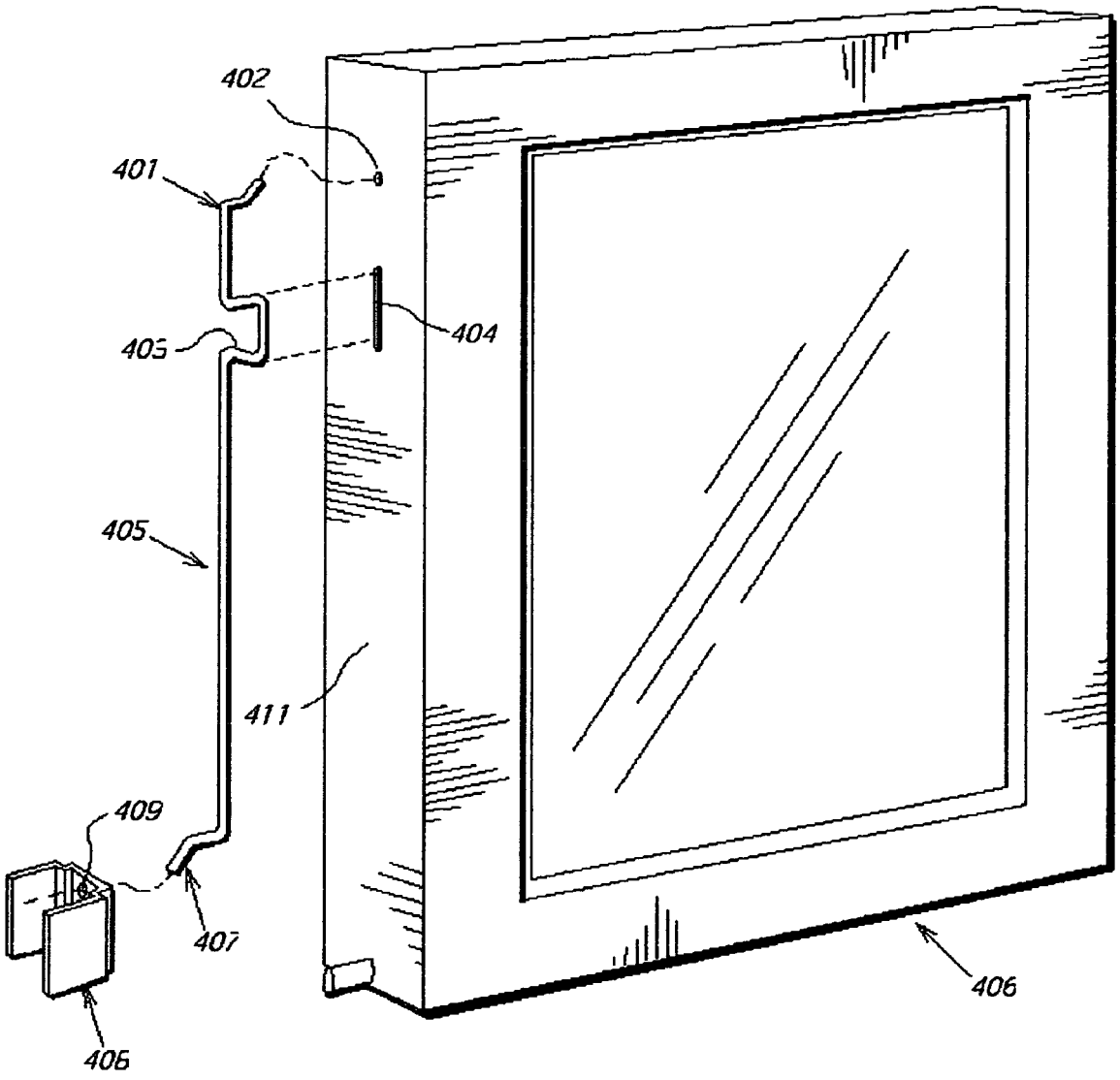

FIG. # 37
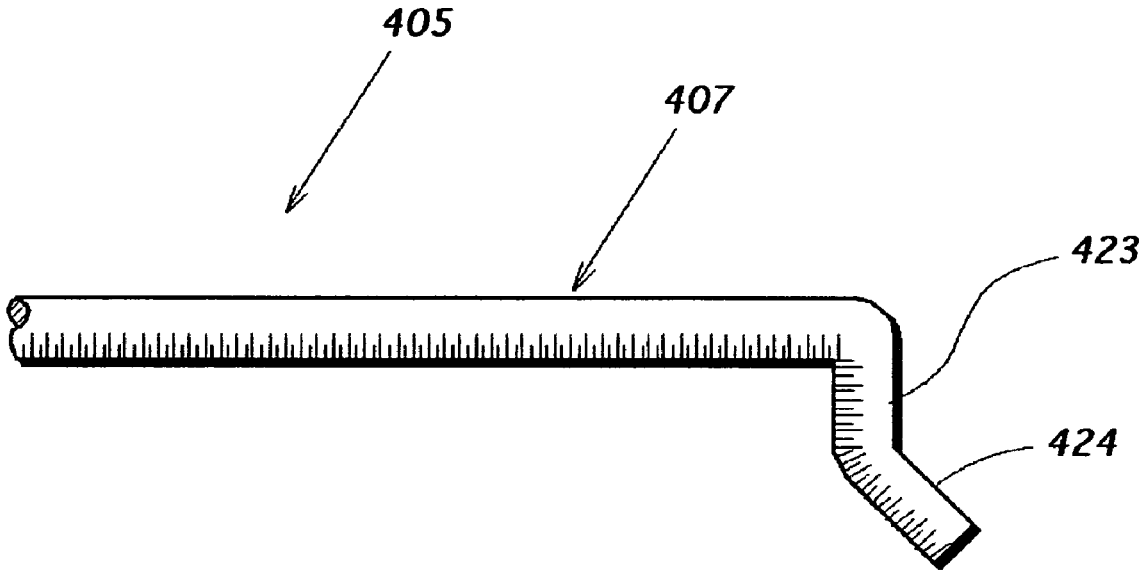

FIG. # 38
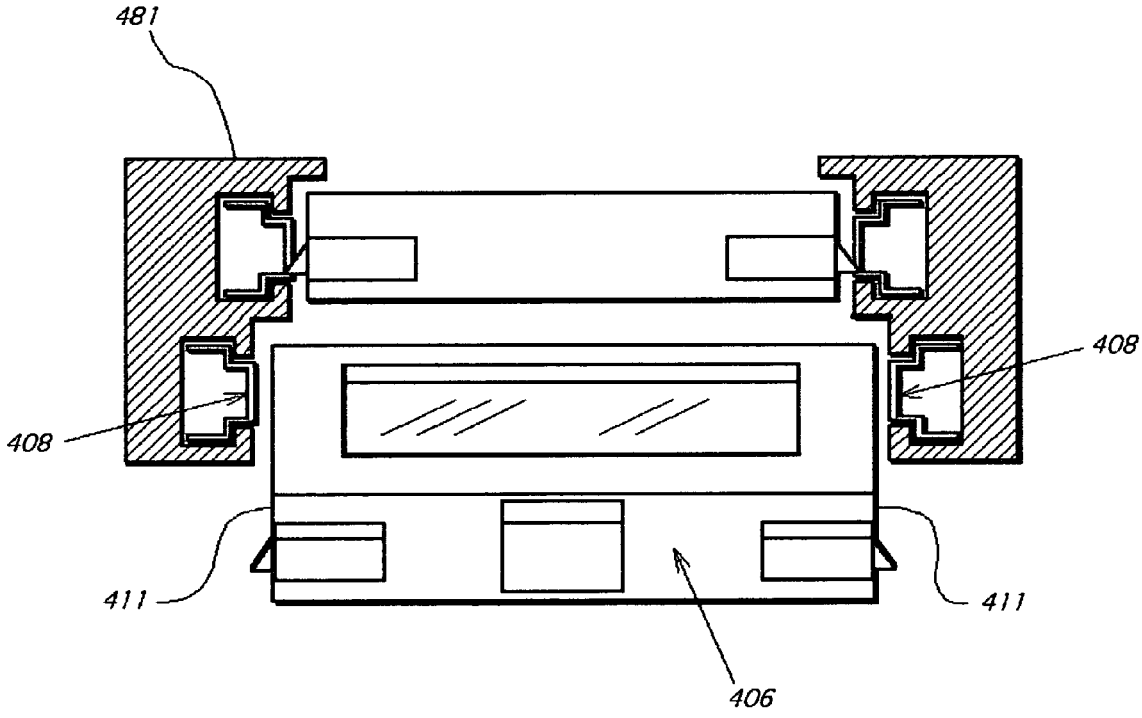

FIG. # 39
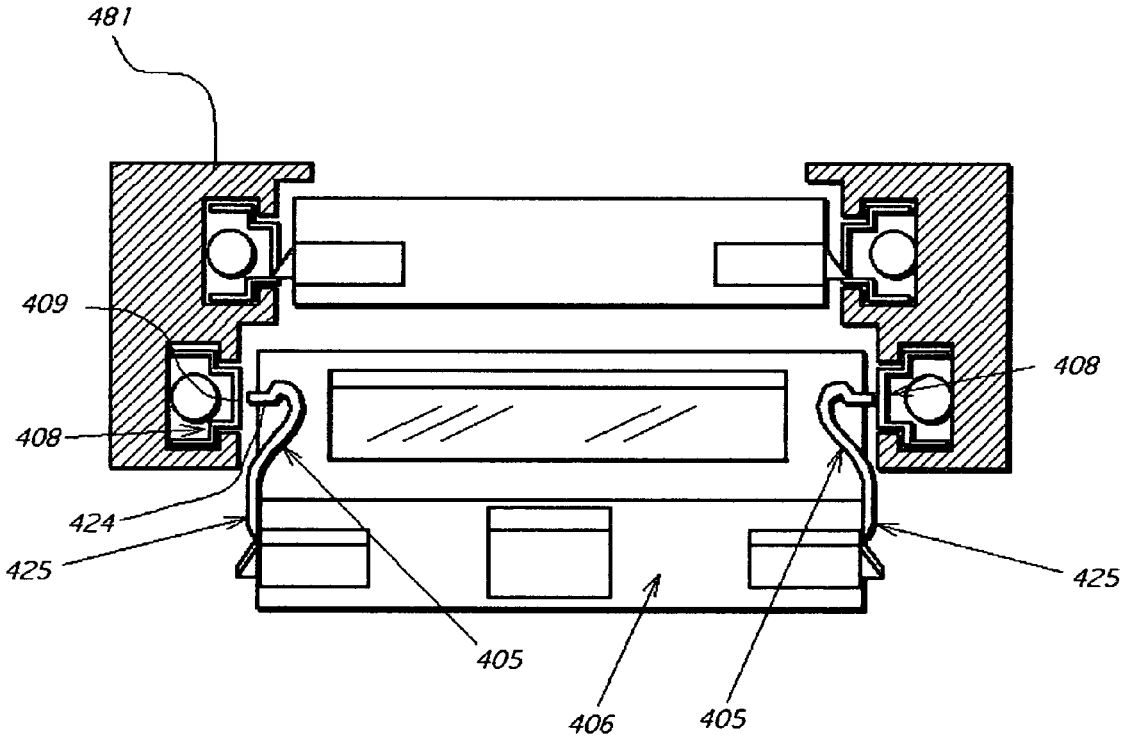

FIG. # 40
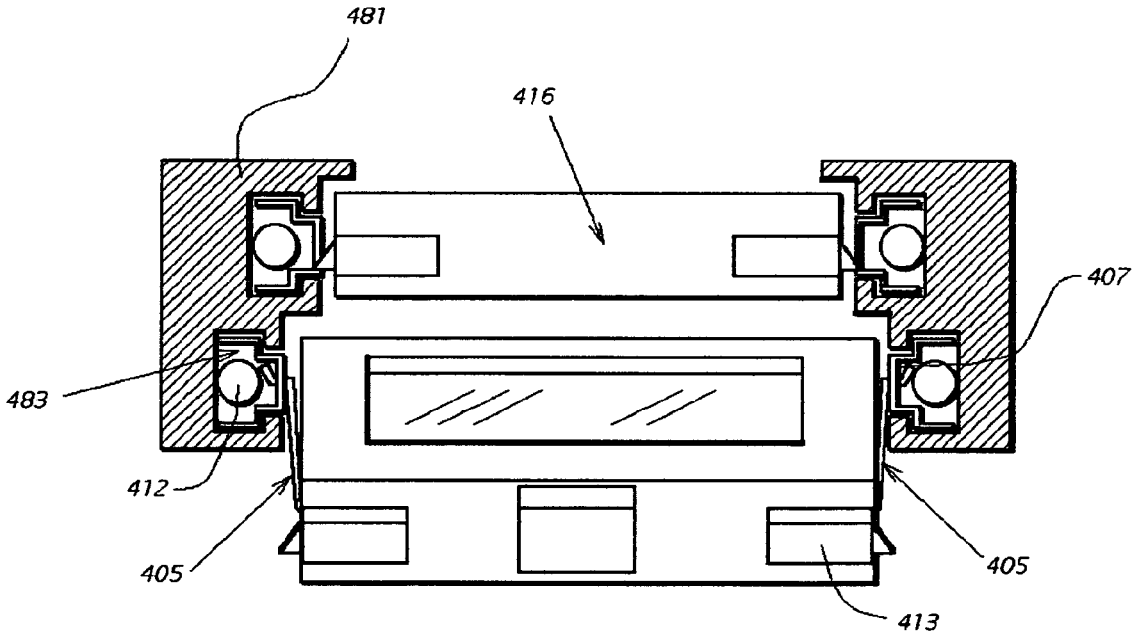

FIG. # 41
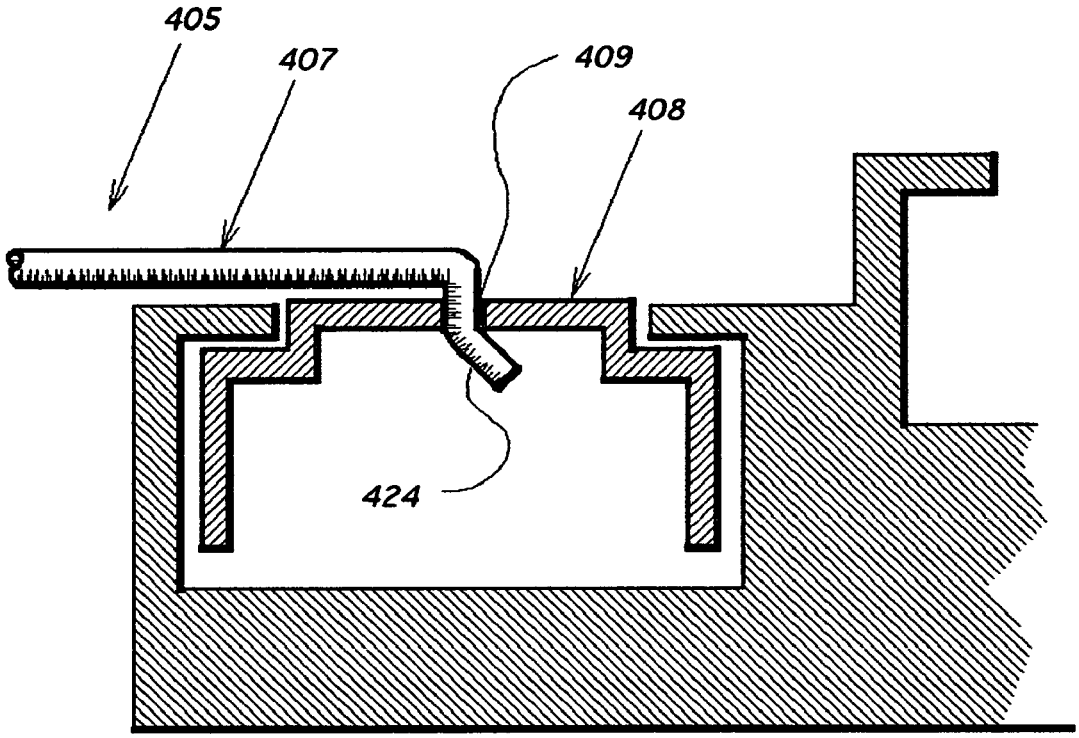

FIG. # 42
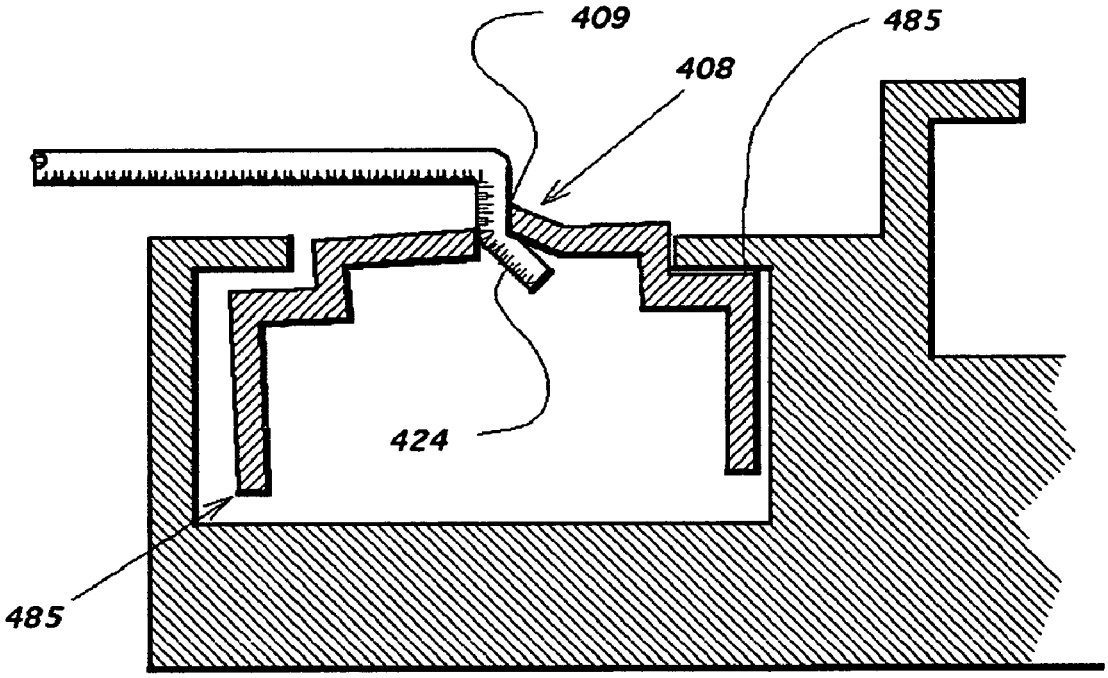

FIG. # 43
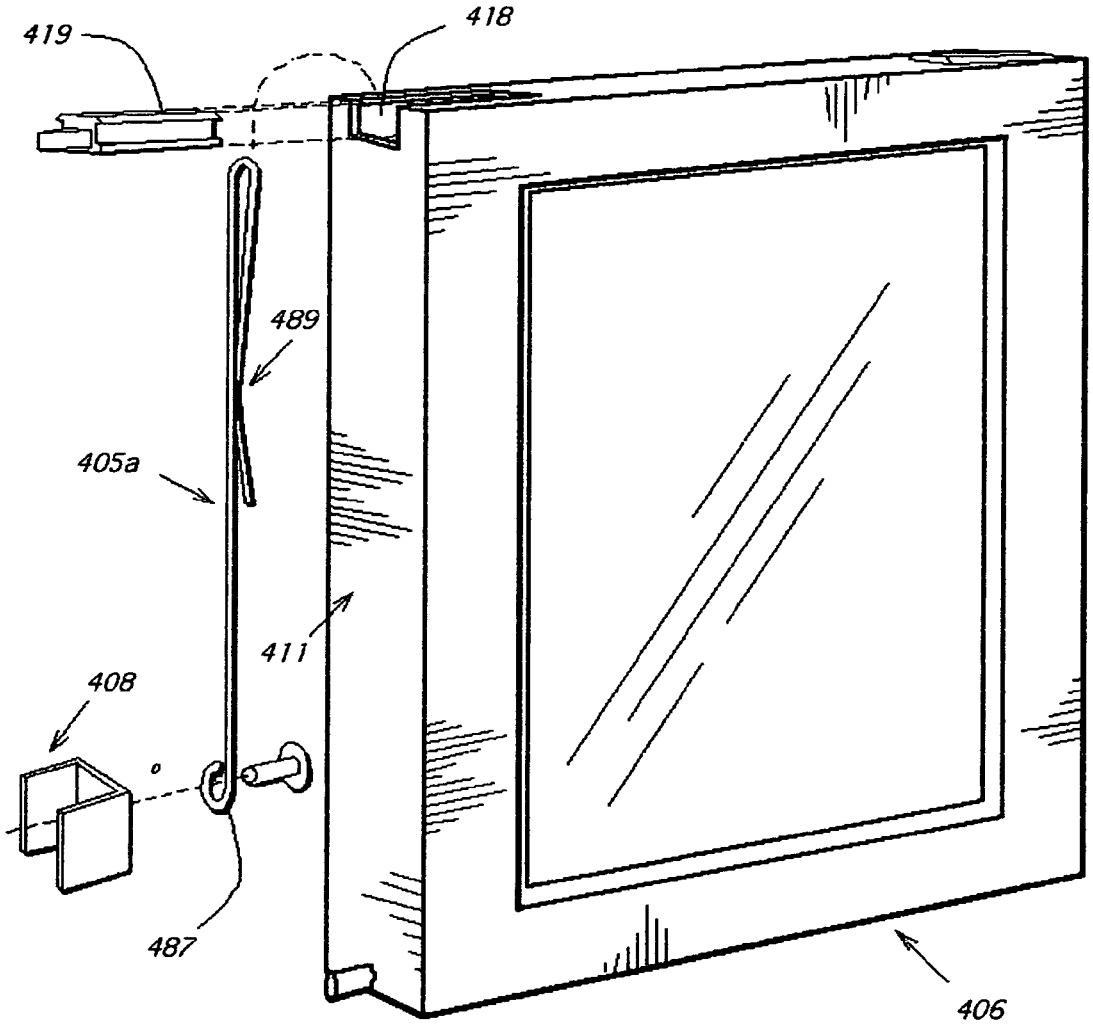

FIG. # 44
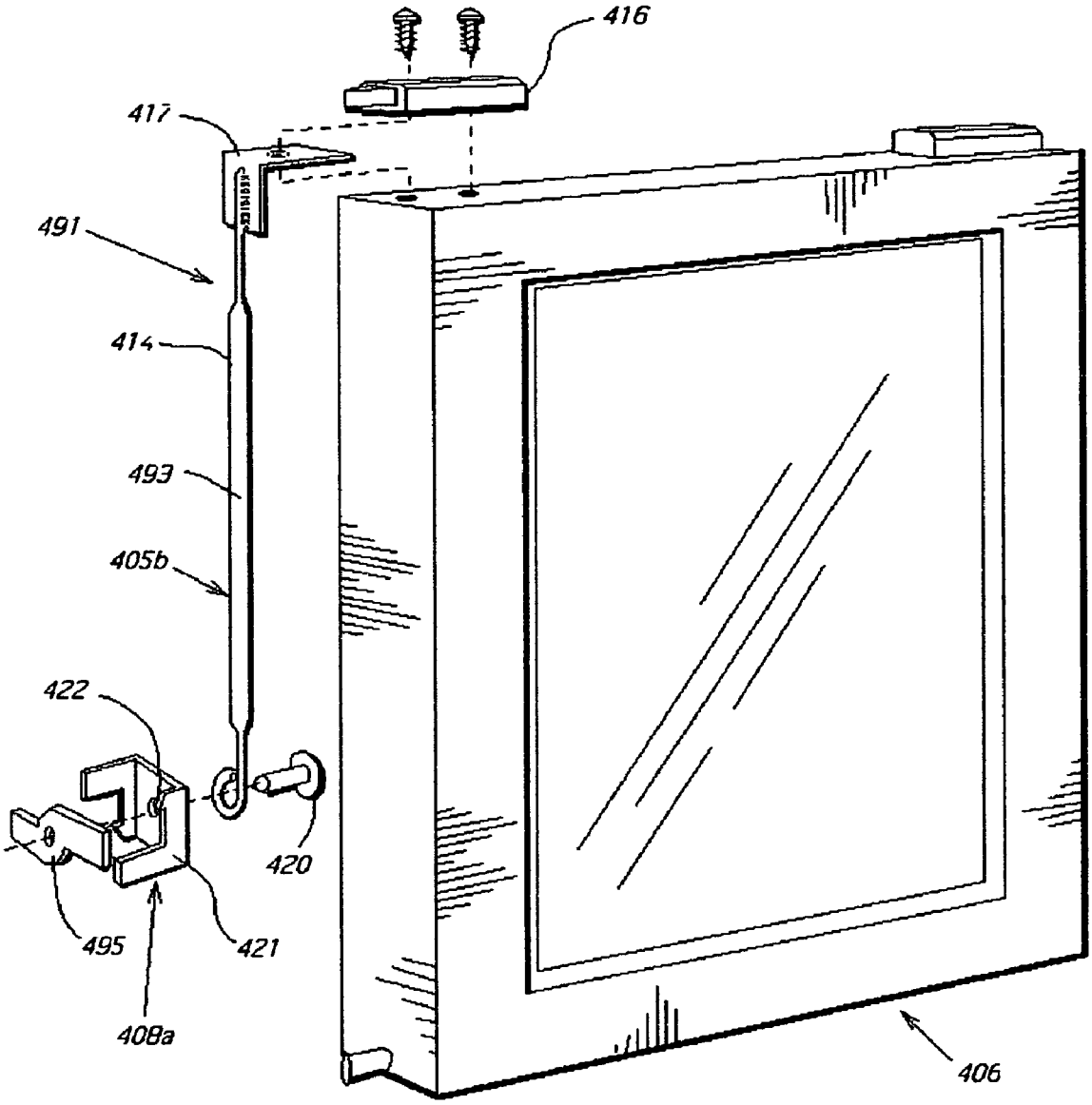

FIG. # 45
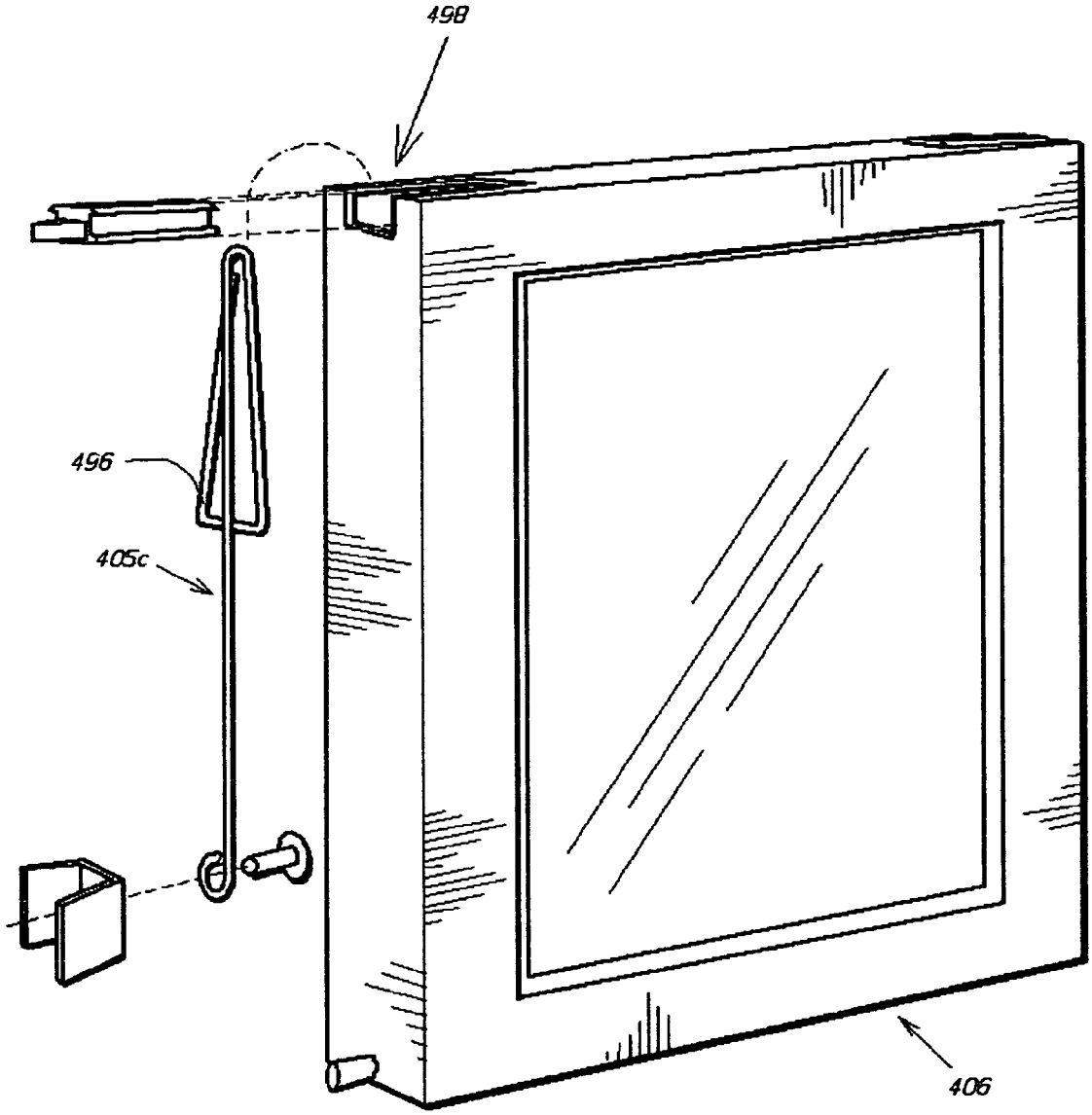

FIG. # 46
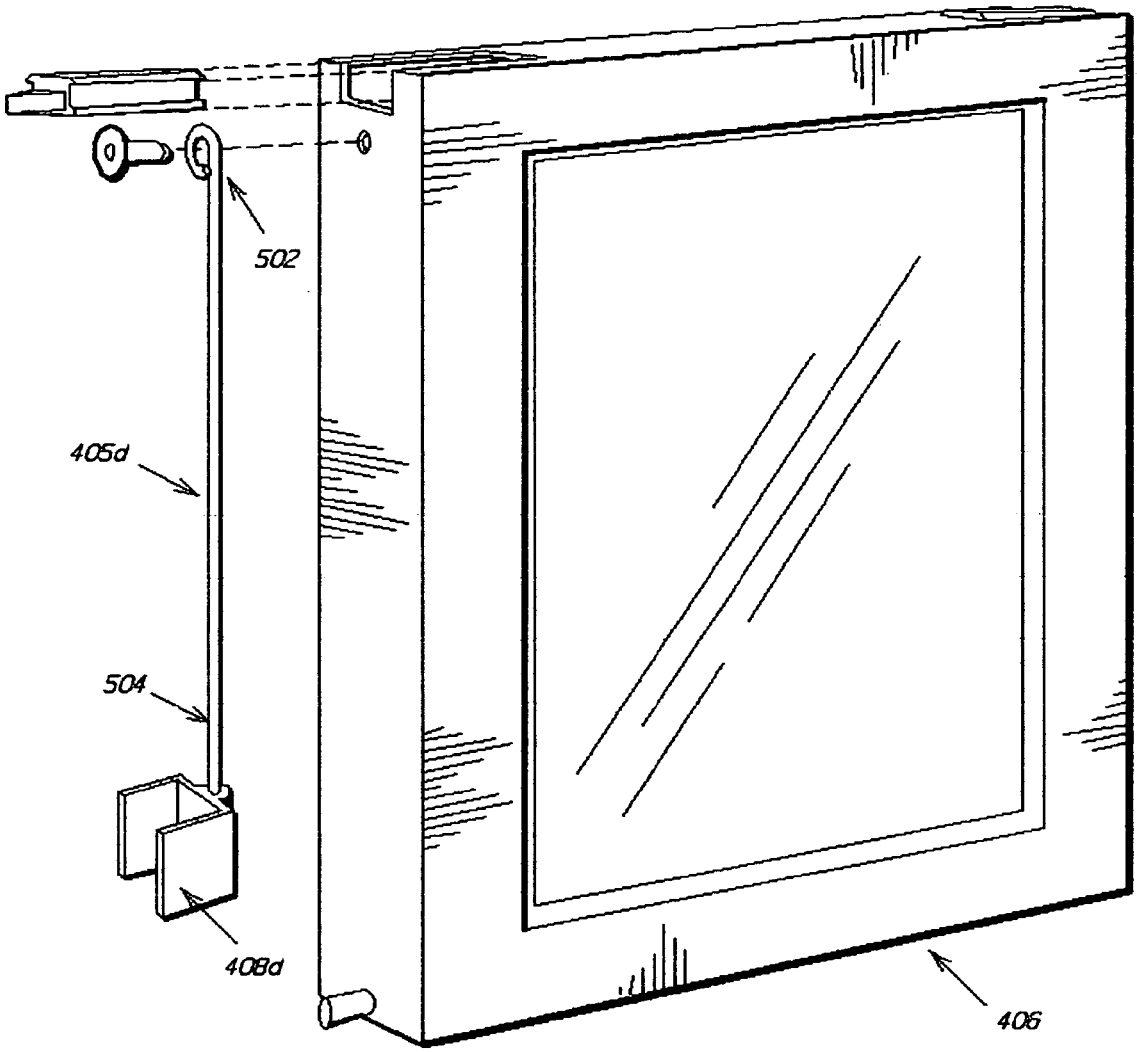

WINDOW SASH TILT CONTROL

RELATED APPLICATIONS

This is a continuation in part of application Ser. No. 10/978,943 filed Nov. 1, 2004, now allowed, which is a continuation in part of application Ser. No. 10/116,915 filed Apr. 8, 2002, now U.S. Pat. No. 6,823,626, which is a continuation in part of application Ser. No. 09/657,243 filed Sep. 7, 2000, abandoned as of the filing of this application.

FIELD OF THE INVENTION

The present invention relates to a window assembly with a sash which is both slidable and tiltable relative to the frame supporting the sash. In a different aspect of the invention, a tiltable sash when open automatically changes angle according to an ambient condition.

BACKGROUND OF THE INVENTION

Many of today's modern windows have sashes which are both slidable and tiltable relative to their supporting frames. The tilt feature adds the benefit that the sash can be cleaned when tilted to an open position. However, this same tilt feature can also be detrimental because current windows that have slidable and tiltable sashes do not include any type of a sash tilt control. Without this control the sash, if not properly handled by the person at the window, can easily fall completely out of the frame creating a very hazardous situation.

In a typical window having sliding and tilting sashes the frame jambs of the window usually have undercut openings known in the industry as balance pockets or channels. These channels contain balancing devices i.e., balance springs or the like which help to hold the sashes at different positions to which they are slid relative to the frame. Any sash tilt control that can be added to current window designs must not interfere with these balance devices. Furthermore, any such sash tilt control must not adversely affect the tilt opening or tilt closing of the sash.

The window industry is very competitive and as such any changes to known window assembly construction are not readily accepted both from a cost and a market appeal standpoint. Therefore, any modifications made to existing windows having slidable and tiltable sashes must be at low cost and should be compatible with current window assembly design.

SUMMARY OF THE INVENTION

The present invention provides a window assembly having a frame, a sash and a low cost sash tilt control which prevents the sash from tilting out of the frame and which is extremely compatible with existing window design.

More particularly, the window assembly of the present invention comprises a frame and a sash in which the frame is elongated relative to the sash and the sash is slidable to different vertical settings within the frame. The frame has side jambs with interior channels opening at the sash. Each of these channels is provided with a balancing device which slides with and balances weight of the sash at the different vertical settings of the sash in the frame.

The sash is further tiltable between a tilted closed and different tilted open positions relative to the frame.

The assembly includes a sash tilt control bar. This bar has a first end attached to the sash and a second end which is slidably held within one of the channels of the frame. The frame, the sash and the bar all vertically align with one another when the sash is in the tilted closed position where the bar is sandwiched between the frame and the sash.

When the sash is tilted open the second end of the bar slides vertically of the channel in which it is held. The vertical sliding of the second end of the bar does not interfere with the balance device in that channel. The vertical travel at the second end of the bar causes the bar to tip away from its vertical position towards a more horizontal position. However, the bar should not reach a fully horizontal position i.e., a position perpendicular to the frame where the bar might otherwise block the tilt closing of the sash. In order to avoid this problem, the bar limits the tilt opening of the sash to positions which do not allow the second end of the bar to travel sufficiently far as to allow the bar to move to a position perpendicular to the frame. This in turn stops the vertical travel of the second end of the bar before the bar tips to a position perpendicular to the frame as the sash is tilted open.

BRIEF DESCRIPTION OF THE DRAWINGS

The above as well as other advantages and features of the present invention will be described in greater detail according to the preferred embodiments of the present invention in which;

FIG. 1 is a perspective view looking down on a window assembly having first and second sashes, the first sash being in a closed position, the second sash being tilted open and both sashes being provided with sash tilt controls according to a preferred embodiment of the present invention;

FIG. 2 is a sectional view of the window assembly of FIG. 1 showing both sashes tilted open and the first sash being slid downwardly from its closed position of FIG. 1;

FIG. 3 is a view similar to FIG. 2 with the sashes and sash tilt controls removed from the window assembly;

FIG. 4 is a front view of a further window assembly made in accordance with a preferred embodiment of the present invention;

FIG. 5 is a sectional view along the lines 5-5 of FIG. 4;

FIG. 6 is a view similar to FIG. 5 showing the upper and lower sashes in tilted open positions;

FIG. 7 is a front view of either one of the sashes from the window assembly of FIG. 4 when removed from the supporting frame;

FIG. 8 is an end view of the sash of FIG. 7 without the tilt limit bar in position;

FIG. 9 is the same view as FIG. 8 but showing the tilt limit bar attached to the sash;

FIG. 10 is an end view of the window assembly of FIG. 4 with the two sashes tilted open relative to the frame;

FIG. 11 is a top view of a tilt limit bar according to a preferred embodiment of the present invention;

FIG. 12 is a side view of the tilt limit bar of FIG. 11;

FIG. 13 is a perspective view showing the engagement of the tilt limit bar with the balance channel of the frame for either one of the sashes from the window assembly of FIG. 4 with the sash tilted open as shown in FIG. 6;

FIGS. 14 through 17 are perspective views of sashes and sash tilt controls according to further preferred embodiments of the present invention;

FIG. 18 is an enlarged view of the outside edge of the sash stile of FIG. 17 showing in phantom the insertion of the end of the sash tilt control bar into the stile opening to receive the bar end;

FIGS. 19 and 20 are perspective views of sashes with sash tilt control arms according to further preferred embodiments of the invention;

FIG. 21 is a front view of a window assembly having a frame supporting a pair of sashes including tilt controls for each of the sashes according to a preferred embodiment of the present invention;

FIG. 22 is a perspective view of the window assembly of FIG. 21 showing the lower sash tilted open with a preferred embodiment of the present invention mounted on the stile and fitted to the frame jamb;

FIG. 23 is a sectional view along lines 3-3 of FIG. 1 showing the sashes closed and in their normal operating position;

FIG. 24 is a sectional view along lines 3-3 of FIG. 21 and similar to the view of FIG. 23 except the sashes are shown tilted open at an angle for ventilation;

FIG. 25 is a view similar to that of FIG. 24 with the exception that the sashes are shown tilted to the position they would take after the spring arms have been affected by atmospheric changes and become more resistant to bending;

FIG. 26 shows a short section of bimetallic material with one side composed of a material having properties different than those of the material comprising the opposite side;

FIG. 27 is a preferred embodiment of the present invention showing the attachment of the spring arm to the window sash;

FIG. 28 is a view showing the attachment of the spring arm according to a further preferred embodiment of the present invention;

FIG. 29 is a view showing the attachment of the spring arm according to yet another preferred embodiment of the invention;

FIG. 30 is a sectional view along lines 4-4 of FIG. 21 with the lower sash opened showing the hook engagement of one embodiment along the wall of the window jamb;

FIG. 31 shows the same embodiment as that in FIG. 30 with the hook positioned for its release and removal from the balance channel of the frame.

FIG. 32 is another preferred embodiment of the present invention showing a spring arm constructed from two dissimilar materials;

FIG. 33 is the assembly shown in FIG. 31 with the spring arm fully bent;

FIG. 34 shows the assembly shown in FIG. 33 but an atmospheric change has caused the spring arm to change shape and move the hook end closer to the sash stile; and FIG. 35 shows an alternate spring arm assembly;

FIG. 36 is a perspective view of an alternate window sash and a small diameter control arm with a jamb-slide connection;

FIG. 37 is a partial top view of the bent end of the wire control bar that engages the jamb-slide;

FIG. 38 is a cross section through a window looking downwardly showing the relationship of the sash and frame;

FIG. 39 is a view similar to FIG. 38 showing insertion of control bars either side of the sash;

FIG. 40 is a view similar to FIG. 39 with one sash tilted inwardly;

FIG. 41 shows the end of the wire control bar retained in the jamb-slide;

FIG. 42 shows the end of the control bar releasing from a jab-slide; and

FIGS. 43, 44, 45 and 46 are perspective view of alternate embodiments of the wire control bar configured for effective engagement with the window sash.

DETAILED DESCRIPTION OF THE PREFERRED EMBODIMENTS

FIG. 1 shows a window assembly generally indicated at 1. This window assembly mounts in an opening of a building wall.

Window assembly 1 is built around a standard window construction and additionally includes novel features of the present invention added to that construction. The assembly 1 can be made from plastic, wood, aluminum or other suitable materials.

The assembly includes a frame 2 which supports sashes 9 and 11. These sashes are both slidable and tiltable relative to the frame. The frame is elongated relative to the sashes to accommodate slide opening and closing of the sashes.

The frame itself is formed of a pair of side jambs 3, header 5 and a sill 7. As seen in FIGS. 2 and 3 side jambs 3 include first and second channels 17 and 19. These channels have an undercut configuration with a relatively narrow mouth which faces at the sash within the frame. The channels widen behind their mouth walls to receive balancing devices generally indicated at 22 and 32.

Balancing device 22 comprises a fixed position cylinder 23. Extending from cylinder 23 is a rod 25 which slides relative to the cylinder. The cylinder contains means, e.g. a spring or the like, which provides resistance to the sliding of the rod. A sash mount 27 is provided on the lower end of rod 25. Sash mount 27 includes a pivot connector 29 to which the lower end of the sash 9 secures as to be described later in more detail.

Balancing device 32 has a similar construction to device 22 and includes a cylinder 33 fixed in channel 19, a rod 35 slidable relative to the cylinder and a sash mount 37 at the lower end of the rod. Sash mount 37 includes a pivot connector 39 which secures to the lower end of sash 11.

In comparing FIGS. 1 and 2 it will be seen that sash 9 is at different height settings in the frame. Balance device 22 is used to offset weight of the sash to hold these different settings. Sash 11 is also slidable to different height settings for a slide opening and closing of the window. Balance device 32 is used to help support sash 11 at these different height settings.

Each of the sashes 9 and 11 is also tiltable relative to the frame for a tilt opening and closing of the window. The sashes tilt open to different tilted settings and in accordance with the present invention tilt control bars 13 and 15 are provided to help hold the sashes in their different tilted positions. These tilt control bars pivotally secure at one of their ends to the respective sash and slidably engage at the other of their ends within the respective balance channel of the frame as also to be described later in more detail. The bars do not in any way interfere with the balance devices in the channels.

The description above shows very generally the window assembly construction including the sash tilt control feature of the window assembly. FIGS. 4 through 6 show, in greater detail, another window assembly which once again incorporates this same sash tilt control. For drawing clarity purposes, the balancing devices are not shown in these particular figures. They are, however, included in the window assembly of FIGS. 4 through 6 and they do operate in the same manner as that already described.

FIG. 4 shows an overall window assembly generally indicated at 101. This assembly comprises a frame 103 which mounts within a building opening and which supports upper and lower sashes 105 and 109 respectively.

Referring now to FIG. 5, frame 103 comprises a header 113, a sill 115 and opposite side jambs 114. Each of these jambs includes a front channel 119 and a rear channel 120.

These two channels which contain balancing devices that are not shown extend essentially the complete height of the frame.

Sash 105 comprises a header 121, a sill 125 and side jambs or stiles 123. The header, sill and jambs of sash 115 hold a glass pane 107.

The sash 109 is formed by a header 127, a sill 131 and opposite side jambs 129. The header, sill and jambs of sash 109 contain a glass pane 111.

The side jambs 123 of the upper sash and more particularly the pivot pins and the spring locks of the jambs are slidably received within frame channel 120 while the pivot pins and spring locks of the side jambs 129 of the lower sash are slidably received within frame channel 119. In order to prevent sliding of the two sashes relative to one another, i.e. for locking the window closed, the window is provided with a lock mechanism 112 having cooperating locking parts on the sill of the upper sash and the header of the lower sash.

The two sashes are not only slidable but additionally they are tiltable relative to the frame. As better shown in FIG. 7 of the drawings, each of the sashes, as represented by sash 105, has a lower end pin 135 and an upper end spring lock 137. The pins connect to the pivot connectors of the sash mounts of the balance devices as earlier described with respect to FIGS. 1 through 3. The pins then ride within the frame channel as do the two spring locks when the locks are in the position shown in FIG. 7. However, the two spring locks are retractable to allow the upper end of the sash to release from the frame for tilt opening of the sash. FIG. 6 of the drawings shows the two sashes in their tilted open positions.

Again, the key to the present invention lies in the provision of a tilt control bar unique to the present invention.

An example of a preferred embodiment tilt control bar generally indicated at 141 is best seen in FIGS. 11 and 12 of the drawings. The bar is used with sash 105. A similar bar 110 is used with sash 109.

Bar 141 includes an elongated bar portion 143 terminated at one end with a short right angle leg portion 145 and a small hole 147 through the main body of the bar near the short leg. The other end of the bar is provided with a hook-like member 149 which extends to the opposite side of the main body of the bar from leg portion 145.

Returning to FIG. 8, it will be seen that the outside surface of the sash jamb 123 includes a pair of vertically spaced holes 151 and 153. Hole 153 is larger than hole 151.

Tilt limit bar is mounted to sash jamb 123 by means of a screw 155 which fits through opening 147 in the bar and threads into sash opening 151. Leg 145 of the bar locates within sash opening 153. The sash opening is oversized relative to the leg allowing the leg some play within the sash opening. However the amount of play is limited to provide a bar movement controller as described later in more detail.

As earlier mentioned the window frame includes channels 119 and 120. These channels not only contain the sash balancing devices but in addition are used to trap one end of the tilt limit bars on each of the sashes.

More particularly, referring to FIG. 13, it will be seen that the hooked end 149 of bar 141 wraps around and locks onto the mouth wall 120 of the undercut balance channel 119. This in no way prevents sliding action of the sash within the frame nor does it interfere with the operation of the balance device. The hooked end of the bar slides vertically of the channel at the same time as, and always stays above, the sash mount of the balance device.

As also earlier mentioned the tilt bar leg portion 145 has some play within the sash jamb opening 153. The mounting of the tilt bar by means of screw 155 in combination with the leg play noted immediately above provides a tilt bar movement controller. This controller limits the amount of pivotal movement of the bar at the sash. The limiting of this pivotal movement in turn controls the amount of vertical slide of the other end of the bar in the frame channel. This is important because the bar should never reach a position perpendicular to the frame where it could easily block the tilt closing of the sash.

More particularly, when the sash is tilted closed the tilt control bar aligns with and is sandwiched between the sash and the frame as shown in dotted lines in FIG. 5. When the sash is tilted open the control bar begins to tip from its FIG. 5 vertical position towards a more horizontal position. During the tipping of the bar two things happen. Firstly, there is a pivoting movement at the connection of the one end of the bar to the sash and secondly the other end of the bar starts to slide vertically i.e., upwardly within the frame channel. However, the bar movement controller, which in this case is leg portion 45 of the bar 53, controls the amount of pivot at the one end of the bar which sets the degree to which the bar is allowed to tip. As soon as the pivoting movement at the sash end of the bar is stopped by the controller, the other end of the bar can no longer ride upwardly in the channel. This happens before the bar can reach the fully horizontal i.e., frame perpendicular position.

In the preferred embodiment as shown the pivot movement between the bar and the sash is controlled to allow the bar to swing or tip through a maximum angle of about 15.degree. This angle is indicated at A in FIG. 6. At this angle of the bar the sash reaches its maximum tilted open position of about 45.degree relative to the frame. This is a position from which the sash can easily be pushed closed.

Another feature of the present invention is that the tilt bar, although normally in its frame engaged position can easily be manually released from the frame. This is done by pushing the sash, when tilted open, towards the closed position and holding the bar from sliding downwardly along the frame channel. By doing this the hooked end of the bar is pushed off of the mouth wall of the balance channel. The bar can then be pushed or flexed inwardly to move the hooked end of the bar out of the channel. When the bar is moved to this disengaged position, the sash can be tilted open as far as desired for cleaning or maintenance purposes.

Although the drawings and description above show the tilt limit bar being used in a double hung window, it could equally as well be used in a single hung window. Furthermore, the degree to which the sash is allowed to tilt relative to the frame could easily be modified from the 45.degree angle described above. The sash should however be limited to a tilt angle of something less than 90.degree when under the control of the bar.

The embodiments described above show only a few of the ways in which to prevent the tilt control bar from reaching a position perpendicular to the frame. Other embodiments of the invention fulfilling the same function are shown in FIGS. 14 through 20 of the drawings. Note that in each of these drawings the sash and the tilt control arm are shown away from the frame but it will be readily understood from each of the figures how they interact with the frame.

FIG. 14 shows a sash 160. A tilt control bar 162 is pivotally mounted at its one end by pivot mount 163 to the sash. The other end of the bar has a hooked end for engaging the balance channel of the frame in the same manner as that found in the earlier embodiments.

In this particular embodiment, the bar movement controller which limits the amount of pivot of the bar relative to the sash is in the form of a pin 167 supported by the sash. The edge of the bar will engage the pin when the sash has reached the degree to which it is allowed to tilt in its fully tilted open position. When the sash reaches this position the tilt control bar is well away from reaching a frame perpendicular position.

In the embodiment shown in FIG. 14, the sash is provided with a plurality of insert holes 165 to selectively receive the pin 167. When the pin is inserted into the uppermost of the holes 165 the sash will be allowed to tilt farther open than it would be if the pin is positioned in one of the lower holes. Therefore, in this embodiment the maximum tilt angle of the sash is adjustable by virtue of the positioning of pin 167.

FIG. 15 shows a sash 170 with a tilt limit bar pivotally mounted at 172 to the sash. Also provided in this embodiment is a flexible or bendable bar movement controller in the form of a chain 174 having one end secured to the bar and the other end secured to the sash.

As will be appreciated from FIG. 15 the sash will reach its maximum tilted open position when the chain is extended to its maximum length. The chain then stops the pivotal movement between the control bar and the sash. This occurs well before the bar is able to reach a position perpendicular to the frame.

FIG. 16 shows a sash generally indicated at 176. A tilt control bar 177 is used to determine the maximum tilted open position for the sash.

In this particular embodiment, bar 177 is provided with a right angular extension 179. This extension, as shown, has a semi-circular configuration with a rounded side 179 and a flat side 181.

Sash 176 is provided with an opening for receiving the extension 179. This opening is defined by a rounded wall part 183 and a flat wall part 185. The rounded wall part circumscribes more than 180 degrees of a circle e.g., something in the neighborhood of about 240 degrees of a circle. This allows a limited pivot of the extension 179 within the opening. The amount of pivot is dictated by the flat edge surface 181 of the extension abutting the flat wall 185 of the opening of the sash. This occurs when the sash has been tilted to its maximum tilted open position of for example, 15 degrees relative to the frame.

FIGS. 17 and 18 show another embodiment of the invention. In this embodiment, a tilt control arm 192 fits with a sash 190. As best shown in FIG. 18 this sash includes a curved slot 194 and the control arm includes a head 196 having a pair of pivot pins 198 and 199 located within the slot 196.

The provision of the two spaced apart pivot pins prevents the head of the arm from rotating relative to the sash.

The sash will tilt open to the point where the pivot pin 199 runs into the upper blind end of the slot 194. This then blocks any further tilt opening of the sash.

It is to be understood that in each of the embodiments shown in FIGS. 14 through 18 the hooked end of the control bars shown in these figures will once again rise in the frame channel. Furthermore this occurs without interfering with the balance device located in the channel in the same manner as disclosed with respect to FIGS. 4 through 11 of the drawings. Also like the FIGS. 4 through 11 embodiment, the amount of pivot at the sash end of the bar is controlled to limit the amount of vertical travel of the hook end of the bar thereby preventing the bar from tipping to a frame perpendicular position.

FIGS. 19 and 20 show still further embodiments of the invention. In each of these embodiments, to be described in more detail below, a sash is fitted with a tilt control bar where the bar once again has a hooked end to slide vertically within a balance channel of a frame. However, unlike the earlier described embodiments the control bar does not pivotally mount to the sash but rather it is the nature of the construction of the bar itself which provides the bar movement control.

More specifically, FIG. 19 shows a sash 201 removed from a frame which slidably and pivotally holds the sash. Provided to one side of the sash is a tilt control bar generally indicated at 203. This tilt control bar is made from a bendable spring steel material.

Bar 203 is provided with a hooked end 205 which hooks onto and slides along the channel mouth wall of the frame which receives sash 201.

The control bar is formed with two loops 207 and 209 directly within the body of the control bar. Fastening devices such as screws or the like are then fitted through the loops into the sash to secure the control bar to the side of the sash.

In this embodiment, as the sash is tilted open, the hooked end of the bar once again slides upwardly along the mouth wall of the channel without interfering with the balance device in the channel. However, the bar does not pivot relative to the sash because of the spaced apart mounting locations of the bar to the sash. Instead the bar bends between the loop 209 and the hooked end 205 of the bar. The amount of bend in the bar is dependent on the strength of the bar material. In all instances using the bar 203 the bar material would be sufficiently strong to prevent the sash from tilting to a frame perpendicular position.

FIG. 20 shows another embodiment using a bendable tilt control bar 13 which fits with a sash 211. In this embodiment, the control bar has a right angle extension 217 at one end of the bar and a hook 215 at the other end of the bar. The extension 217 secures within a sash opening 219. The hook 215 slidably mounts to the mouth wall of the channel of the frame which receives sash 211.

Additionally provided is a bar to sash fastening device 223. The sash includes openings 225, 227 and 229 to selectively receive a screw or the like to attach fastening device 223 to the sash.

The provision of the extension 217 secured within the sash and the mounting of the fastening device 223 spaced from extension 217 prevent the bar from rotating relative to the sash. As the sash is tilted open the hooked end 215 of the bar once again slides vertically upwardly along the balance channel without interfering with the balance device in the channel. At the same time the bar bends between fastening device 223 and the hooked end 215 of the bar. The resiliency and stiffness of the bar dictate the degree to which the sash can be tilted open. In all instances, the sash will not tilt to a position in which the sliding end of the bar travels sufficiently far to place the bar in a frame perpendicular position.

When the fastening device 223 is secured at sash opening 225 the sash will tilt farther open than it will when the fastening device is secured at sash opening 227. The least amount of tilt is provided when the fastening device is secured at sash opening 229. The reason for this is that the lower the fastening device is located along the body of the bar, the less the bar will bend. By lowering the fastening device there is a decrease in the length of bar material between the fastening device and the hooked end of the bar. This stiffens the bar in the region where the bar bends with the tilt opening of the sash.

FIGS. 21 and 22 show a window assembly generally indicated at 1. This window assembly is formed by a frame comprising side jambs 303, a header 305 and sill 307. Contained within that frame is a pair of sashes 313 and 315. Both of the sashes are closed relative to the frame. Lock 317 cooperating between the top of the lower sash and the bottom of the upper sash holds them in their closed positions.

As will be described later in detail both of the sashes can be opened in a sliding mode upon release of lock 317 and a tilting mode upon the release of locks 316, 317 and 318.

FIG. 22 shows locks 316, 317, and 318 released and lower Sash 315, being tilted inward of the frame. The first end of spring arm 320 is mounted to the sash stile 319 at 321 and 365. The second end of spring arm 320 is engaged with frame jamb 303 as will be described later in greater detail.

FIG. 23 shows FIG. 21 through section 3-3 whereby sashes 313 and 315 are slidably attached to and slide along a pair of channels 309 and 311 located in the window frame jamb. The other jamb has the identical construction.

Both of these channels are referred to in the industry as balance channels. Balance channel 309 is located to the interior side of the window i.e., the side of the window facing the interior of a building in which the window is used while balance channel 311 is located to the outer side of the window.

FIG. 23 also shows slide members 375 and 376 mounted within channels 309 and 311. The sashes are pivotally connected to the slide members with pins 326 and 327 respectively located at the lower edges of each of the sashes. Latches 316 and 328 keep the sashes vertical relative to the frame. This mounting is identical to both sides of the window.

More specifically, rigid slide member 375 is trapped within balance channel 309 while rigid slide member 376 is trapped within balance channel 311. The lower end of sash 315 is pivotally mounted at 326 to slide member 375 while the lower end of sash 313 is pivotally mounted at 327 to slide member 376. As will be appreciated from FIG. 23, when lock 317 is released both sashes and their corresponding slide members are slidable relative to the frame in their respective channels providing for the slide opening of the window.

FIGS. 24 and 25 show sashes 313 and 315 also being openable in a tilting manner relative to the frame. Here it will be seen that when latches 316, 317 and 328 along with latches 318 and 329 which are hidden from view are released sashes 313 and 315 are no longer locked in relation to the frame and the upper end of the sashes are free to rotate outwardly and downwardly away from the frame. The two sashes can be tilted open one at a time or simultaneously with one another.

Each sash is also provided with a tilt control. In FIGS. 23, 24 and 25 the tilt controls are in the form of spring arms 320 and 340 mounted rigidly to the sash stiles at their first end at locations 321 and 365 on sash 315 and at 371 and 379 on sash 313. Hook 352 is mounted to the second end of spring arm 320 and hook 372 is mounted to the second end of spring arm 340. Each of these hooks is inserted into corresponding channels 309 and 311 in the frame jamb. Such a combination may be provided to only one side or to both sides of each of the sashes.

More specifically, referring to the embodiment in FIGS. 23, 24, and 25 spring arms 320 and 340 are used to control tilting movement of sashes 315 and 313 respectively to prevent a free falling of the sashes from their fully closed to their fully tilted open position.

Referring to lower interior sash 315, control arm 320 has a first end secured at 321 and 365 to the stile of sash 315 and a second end in the form of a circular hook 352 slidably trapped within channel 309 of the frame jamb. In comparing FIGS. 23, and 24 it will be seen that as sash 315 is tilted farther open i.e., moved to increased tilt angles, hook 352 of spring arm 320 slides upwardly along channel 309 of the jamb causing spring arm 320 to bend outwardly and upwardly relative to points 321 and 365. The bending moment and tension within spring arm 320 increases until the second end of the spring arm bends to a point where spring arm attachment points 321 and 365 are applying a pulling force to hook 352 that is nearly perpendicular relative to the frame at which time the sash reaches its maximum tilt angle of something less than 90 degrees relative to the frame.

As can be seen from FIGS. 23, 24, and 25 two separate forces counteract one another during the tilt opening of the sash. Firstly, the downward loading of the sash on the spring arm increases the farther the sash is tilted open. This is due very simply to the outward levering of the weight of the sash as the sash moves from a more vertical to a more horizontal position i.e., as the upper end of the sash moves downwardly and outwardly away from the frame.

At the same time as the sash applies increasing force on the tilt control arm the bending of spring arm 320 becomes more pronounced which in turn provides increased resistance to the tilt opening of the sash the farther the sash tilts open. This resistance is not sufficient to prevent the tilt opening of the sash, but it is sufficient to prevent a free falling of the sash.

As will also be apparent from FIGS. 23, 24 and 25 the tilt control i.e., spring arms 320 and 340 or hooks 352 and 372 do not block sliding of the sash within the frame.

FIG. 25 shows sashes 313 and 315 tilted to intermediate positions between those seen in FIGS. 23 and 24. The sashes can be set to this position under normal operator control but can also be moved to this position by an unattended means if spring arms 320 and 340 were to be constructed from bimetallic materials and formed to provide movement as shown in the preferred embodiment in FIG. 35 to cause the spring arms to move in a forward and backward direction perpendicular to the window frame. The warping of the spring arms causes the sashes to tilt closer to the window frame or to tilt to an angle further away from the window frame depending on atmospheric conditions surrounding the spring arms.

FIG. 26 shows a section of a spring arm manufactured from two different materials 332 and 333 that have been bonded together at 334. Each of the two materials exhibit different behaviors when subjected to specific atmospheric conditions. When bonded materials 332 and 333 are shaped to form a spring arm and subjected to atmospheric changes affecting one of the materials the spring arm will be caused to warp to varying and predictable positions.

For example, bimetallic warping behavior will be observed in the spring arm shown in FIG. 26 if materials 332 and 333 have different expansion and contraction rates over a specified temperature range.

It can be appreciated how the shape of spring arm 320 and position of hook 352 shown in FIG. 35 would be altered if coil 380 were composed of the aforementioned bimetallic materials where the exterior side of the material composing the coil decreased its length in colder temperatures while the interior side remained essentially the same length.

Referring back to FIG. 25, sashes 313 and 315 are shown rotated toward the closed position from the more rotated open position of FIG. 24 due to local atmospheric conditions causing bimetallic spring arms 320 to alter their shape forcing hook 352 to move toward the sash stile. This movement causes the sash to rotate toward a more closed position.

FIG. 27 shows a spring arm assembly generally indicated at 350 formed from a single piece of spring material.

More specifically, the spring arm assembly shown in FIG. 27 comprises a generally straight arm with a hook 329 and a leg portion 331 that mates with port 321 in the sash stile. Located between hook 329 and leg 331 is a loop 330 formed to accept screw 323. Screw 323, loop 330 and hole 365 aligning to allow the spring arm assembly to be secured to the sash stile.

FIG. 28 shows a similar spring arm with the following exceptions: Hook 341 has been shaped to make inserting and removing the hook from the window jamb balance pockets more difficult. The action required in inserting and removing this configuration will be described in greater detail further on in the description.

Unlike the earlier embodiment the spring arm does not make use of a loop in the spring arm material rather it uses a separate clip 335 that secures a portion of the spring bar to the sash stile with a screw 339. Clip 335 can be moved and secured at locations closer to as shown at 337 or further away as shown at 336 from leg 331 providing more or less initial spring stiffness and more or less angles of tilt allowable to the sash.

Like the earlier embodiment the spring arm shown in FIG. 28 includes leg 331 at the first end that fits into port 321 located on sash stile 319.

FIG. 29 shows a further embodiment of the invention where leg 331 does not fit directly into an opening in sash stile 319 but rather fits into opening 353 located in a separate fitting 355. Opening 353 is further elongated to allow leg 331 free movement of several degrees. This free movement allows spring arm 320 to pivot around screw 358 far enough so the sash is able to free fall a short distance before encountering spring resistance. Screw 358 is mounted through hole 357 in the spring arm and secures into fitting 355. Fitting 355 attaches to opening 356 in sash stile 319.

As will be seen in FIG. 29 hook 352 is the same hook shown in FIGS. 23, 24 and 25. This hook is more difficult to remove from the window balance channel than the hook indicated in FIG. 27.

FIG. 30 shows another view of the embodiment in FIGS. 23, 24, 25 and 29 looking through section 4-4 of FIG. 21. The inner sash has been tilted in for ventilation and is in position for removal of hooks 352 and 362 from side jambs 303.

FIG. 31 shows how spring arm 320 must be positioned and bent by the operator to enable release of hooks 352 and 362 from side jamb 303. In this position hooks 352 and 362 can be easily slid out of their respective balance pockets and the sash can be tilted fully open or removed for maintenance. By reversing the above action hooks 352 and 362 can be reinserted into their respective side jambs.

FIG. 32 shows an embodiment where two spring arms 361 and 362 are used in conjunction. Both spring arms are unattached at their centers and joined at their ends 363 and 366. Spring arm 361 is constructed from a different material than spring arm 362. In this case spring arm 361 is constructed from a material having an expansion and contraction rate that is greater than that of spring arm 362 over the 0.degree. F. to 100.degree. F. temperature range. FIG. 32 shows the configuration of spring arms 361 and 362 in the closed and normal operating position at a temperature of 70.degree. F. Hook 352 is slidably held in balance channel 309 (not shown for clarity) and pivot bar 326 is held in slide member 375 which is also slidably held in frame balance channel 309. Both hook 352 and pivot bar 326 are lined up with stile 319 and the sash 315 is in its vertical and normal operating position. Referring back to FIG. 30, sash 313 is seen in its closed position resting against frame steps 387 and 388. In this configuration it can be appreciated when extreme cold temperatures exist at the exterior face of the window and bimetallic spring arm material is used the resulting bimetallic reaction will force hooks 372 and 382 inwardly against the interior walls of their corresponding balance channels causing sash 313 to press more firmly against steps 387 and 388 further improving the window's efficiency in cold weather.

FIG. 33 shows the configuration of spring arms 361 and 362 at a temperature of 700F. as shown in FIG. 32 after the sash has been tilted open to the greatest extent allowed by the bending of spring arms 361 and 362 for ventilation. Hook 352 and pivot bar 326 remain lined up vertically but stile 319 is now rotated away from vertical by about 30 degrees.

FIG. 34 shows the configuration of spring arms 361 and 362 as shown in FIG. 33 after the temperature has dropped to 40 degrees. Because spring arm 361 is made from a material having a greater expansion and contraction rate than spring arm 362 it has contracted sufficiently along its length to cause spring arm 362 to straighten. Hook 352 and pivot bar 326 continue to be lined up vertically but the straightening of spring arm 362 has caused sash 315 to rotate to a 20 degree angle.

FIG. 35 is yet an alternate embodiment of a spring arm assembly 350. The assembly includes a retaining guide 352 releasably captured in channel 309 or 311. Alternately, retaining guide 352 may be of such size and shape to be permanently captured within channel 309 or 311 and the spring arm releasable from retaining guide hole 359. In this embodiment spring arm 320 includes an integral wound coil 380 to be received and preferably retained within port 365 of sash stile 319. The coil wire includes a retaining segment 383 integral with the transition arm 385 terminating in the inward directed leg portion 331 received in port 321. A clip 381 and screw 323 secure transition arm 385 to the sash stile 319.

Coil 380 can be composed of bimetallic or other suitable spring material having a high rate of thermal movement. When exposed to temperature variations expansion or contraction of the material wound within the coil amplifies movement of spring arm 320 producing an opening or closing force on the sash.

The spring arm assemblies are made of suitable gauge material to avoid any interference in the operation of the sash.

As can be seen from the different wire spring arm assemblies, the wire is preferably a continuous wire configured with bent or adapted ends for retention in a sash or channel and often include an offset intermediate the length of the wire for retention in the sash. This intermediate offset portion can also be designed to act as a securement section. The wound coil intermediate portion can also act as an amplifier increasing the response of the wire to changes in atmospheric conditions.

FIG. 36 is a perspective view of a preferred embodiment of the invention where the bar 405 is composed of a small diameter spring steel wire having a first end of the bar 401 for insertion into hole 402 formed in the sash stile 411. The bar 405 is rotated downwardly until loop 403 snap-fits into slot 404 holding the bar against and parallel with the sash stile 411. The second end 407 of the bar 405 is fed through hole 409 located in jamb-slide 408. Though not shown in this view, sash 406 and jamb-slide 408 are mounted within and are able to slide along a channel in the frame jamb of the window.

FIG. 37 shows a detail of the second end 407 of the bar 405 shown in FIG. 36. The second end 407 includes a pivot shaft 423 bent 909 to the elongate axis of control bar 405 with an additional end segment 424 bent approximately 459 to the pivot shaft 423 of the wire. The angle of end segment 424 can be adjusted to increase or decrease the force required to disengage the wire from hole 409 in jamb-slide 408. The attachment and disengagement of the spring wire from the jamb-slide 408 is described in detail in FIGS. 38, 39, 40, 41 and 42.

FIG. 38 shows the relationship of the sash 406, frame 481 and jamb slide 408. In this view, looking at a cross section of the window from above, the lower sash has been rotated slightly inward in preparation for the installation of the bars onto the sash stile 411 and insertion into the jamb-slide 408.

In FIG. 39, the control bars 405 have been attached to the sash 406 at 425 and the center portions of the bars have been bent inwardly until end segment 424 aligns with the hole 409 located in the corresponding jamb-slide 408.

FIG. 40 shows the control bars 405 after insertion into the jamb-slide holes 409 and bending pressure on the center portion of the bars has been released. The bars have sprung back into their original configuration and bending near the attachment points close to the sash when the sash is tilted open as shown in earlier FIG. 22.

Additionally shown in FIG. 40, the sash 406 has been left in its tilted in position and is prevented from free falling by the attachment and spring action of the bar 405. The wire control bar bends intermediate the attachment points at the sash 406 and the jamb-slide, causing the jamb slide to move vertically along the balance track 483 without interfering with window sash balance 412. Tension on the spring arm limits the vertical movement of the jamb-slide and stops the jam-slide before the arm 405 moves to a position perpendicular to the frame 481. An identical arm and spring combination is used to control sash 416. A releasable latch 413 allows tilting open of the sash.

FIG. 41 shows the second end 407 of the spring wire control bar 405 inserted into the jamb-slide 408 and rotated to the tilted in position (no torsion on bar). The angled segment 424 prevents the wire control bar 405 from pulling out of hole 409 in jamb-slide 408 and disengaging from the jamb-slide 408 during normal sliding and tilting operations of the sash. Jamb-slide 408 is composed of a semi-rigid material such as glass-filled nylon or spring steel making it capable of deforming without breaking and accommodating sliding in the window frame.

As shown in FIG. 42, excessive outward and/or downward pressure on the sash 406 has increased stress on the tilted in sash causing the wire to move out of hole 409. The angled segment 424 has distorted the material surrounding the hole in jamb-slide 408. The excessive pressure has also caused the jamb-slide 408 to rotate a few degrees within the balance 483 channel causing the jamb-slide shoulder 485 to deflect. Additional pressure applied to the sash causes the angled end segment 424 of the control bar 405 to distort the jamb-slide material further until angled segment 424 is able to pull free of hole 409 in jamb-slide 408 releasing the window sash and allowing it to pivot inwardly fully. This disengagement under excessive stress prevents damage to the jamb-slide, wire or window frame, should excessive weight be applied accidentally or intentionally. The formed angle of angle segment 424 determines the force required to pull the bar 405 free of hole 409 in combination with the jab-slide. The closer to parallel segment 424 is formed to the elongate axis of bar 405 the greater the force required to release it from jamb-slide 408. Conversely the more flexible the material of jamb-slide 408, the less force required to disengage the bar 405 from hole 409. (NOTE: Tests with glass filled nylon jamb-slides and 0.080 diameter spring stainless steel wires show a release force of about 100 lbs. per side).

FIG. 43 shows a preferred embodiment where the first end of a formed spring wire bar 405*a* is inserted into a tooled hole 418 located at the upper corner of sash 406 used to retain slide-in tilt latches 419 of the type found in many modern window designs. This embodiment also shows how a jamb-slide 408 can be rotatably riveted to a loop 487 formed in the second end of spring wire control bar 405*a*. The jamb-slide in this embodiment would be non-releasable from the balance pocket in the window jamb except at cutouts located at the head and sill of the window in which it is installed. These cutouts are normally provided for replacement of the window balance shoe devices. If the window in which the tilt device is installed contains these cutouts, this is a viable way of inexpensively installing the control bar assembly after the window has been installed, or at a later date. Control bar 405*a* includes a loop insertion segment 489 that is received and held in the sash stile 411.

FIG. 44 shows another preferred embodiment of a modified control 405*b* having a first end 491 attached to plate 417 formed to fit underneath surface mounted hardware 416 used with many other modern window designs. This embodiment also shows a flattened portion 493 of the control bar 405*b* located between the upper sash attachment point and the jamb-slide attachment point at the second end of the control bar 405*b*. This flattened portion 493 of control bar 405*b* more easily fits the through the narrow gap between the sash and the frame of the window. It is important to note that this flattening of the wire will work equally well in all the preferred embodiments described herein.

FIG. 44 also shows an additional embodiment whereby a rotatably mounted component 495 cooperates with the modified jamb-slide 408*a* enabling the jamb-slide 408*a* be removed. As can be seen in FIG. 44 the rotatably mounted component 495 is attached by rivet 420 that is used to attach control bar 405*b* to jamb-slide 408*a*. Jamb-slide 408*a* is also fitted with notches 421 and cam latches 422 that releasably hold rotatably mounted component 495 in position perpendicular to the direction of movement of jamb-slide 408*a*.

FIG. 45 shows a further variation where control bar 405*c* includes an end segment 496 that is fed through hole 498 that has been formed to closely match the width of the end segment 496. This reduces movement of the control bar 405*c* at the first end and makes the attachment of the bar to the sash more rigid. It is understood this widened section may also be accomplished by welding, brazing or otherwise attaching the first end of the bar to a plate which fits snugly into hole 498 of the sash.

FIG. 46 shows a further modified control bar 405*d* where the first end 502 of the control bar is pivotally attached to the sash stile and the second end 504 of the control bar is held rigid at jamb-slide 408*d*.

It is also possible to have both ends of the control bar non pivotally secured to the sash and the jamb-slide. This may produce an "S" bend in the control bar during tilting opening of the sash.

The control bar and jamb-slide arrangement shown in FIGS. 36 to 45 can be installed as a retrofit arrangement for many recently installed windows.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A window assembly comprising a frame and a sash, the frame being elongated relative to the sash and the sash being slidable to different vertical settings in the frame, said frame having side jambs with interior channels opening at the sash, each of said channels being provided with a balancing device which slides with and balances weight of said sash at the different vertical settings of the sash in the frame, said sash also being tiltable between a tilted closed position aligned with said frame and different tilted open positions angled relative to the frame, said assembly further including a control bar to limit tilting movement of said sash; said control bar having a first end attached to said sash and a second end which is slidably held within one of the channels of the frame, said frame, said sash, and said control bar all being vertically aligned with one another and said bar being sandwiched between said frame and said sash when the sash is in the tilted closed position; said control bar being secured between said sash and said one of said channels to be distorted as the sash is tilted and additionally causing the second end of the bar to slide vertically relative to the one of the channels of the frame within which the second end of the bar is slidably held without interfering with the balance device therein resulting in a horizontal tipping of the control bar as the sash is tilted open; said control bar distorting and developing a force of a magnitude as said sash is tilted open to limit the tilted open positions of said sash to inwardly and upwardly angled positions of said sash relative to said frame; and wherein said control bar is pivotally secured to a jamb-slide retained in said one channel, said control bar including a bent end segment forming a pivot shaft terminating in an angled latch segment.

2. A window assembly as claimed in claim 1 wherein the control bar is a wire bar made of spring steel.

3. A window assembly as claimed in claim 2 wherein said control bar includes a bent end segment inserted in and retained in a port of said sash and an adjacent bent segment received and retained in a retaining port of said sash to allow bending of said control bar as said sash is tilted open.

4. A window assembly as claimed in claim 1 wherein said angled latch segment and said jamb-slide cooperatively deform and release from one another it an excessive downward force is applied to said sash during tilt opening thereof.

5. A window assembly as claimed in claim 4 wherein said jamb-slide is made of a glass reinforced plastic.

6. A window assembly as claimed in claim 4 wherein said excessive force is of a magnitude of about 200 lbs. and said window assembly includes two control bars to opposite sides of said sash.

7. A window assembly as claimed in claim 1 wherein said first end of said control bar includes a securement segment received in an interior cavity of said sash and a retaining member for maintaining said securement segment in said sash.

8. A window assembly as claimed in claim 7 wherein said retaining member is a tilt latch member.

9. A window assembly as claimed in claim 7 wherein said securement segment is a looped insertion segment retained in a stile of said sash.

10. A window assembly as claimed in claim 1 wherein said first end of said control bar includes a flange member secured to a top surface of said sash.

11. A window assembly as claimed in claim 10 wherein said flange member and a tilt latch member are commonly secured to said top surface of said sash.

* * * * *